US010301881B2

(12) United States Patent
Mada et al.

(10) Patent No.: US 10,301,881 B2
(45) Date of Patent: May 28, 2019

(54) FIXED CUTTER DRILL BIT WITH MULTIPLE CUTTING ELEMENTS AT FIRST RADIAL POSITION TO CUT CORE

(71) Applicant: Smith International, Inc., Houston, TX (US)

(72) Inventors: Hemachandar Mada, Houston, TX (US); Michael G. Azar, The Woodlands, TX (US); Jason R. Gregg, Conroe, TX (US); Joshua Gatell, Cypress, TX (US); Edward Wayne Gutierrez, Houston, TX (US); Suman Velvaluri, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 569 days.

(21) Appl. No.: 14/482,965

(22) Filed: Sep. 10, 2014

(65) Prior Publication Data

US 2015/0068815 A1 Mar. 12, 2015

Related U.S. Application Data

(60) Provisional application No. 61/876,630, filed on Sep. 11, 2013.

(51) Int. Cl.
*E21B 10/43* (2006.01)
*E21B 10/02* (2006.01)

(52) U.S. Cl.
CPC ..... *E21B 10/43* (2013.01); *E21B 10/02* (2013.01)

(58) Field of Classification Search
CPC ..... E21B 10/02; E21B 10/43; E21B 10/485; E21B 25/10
See application file for complete search history.

(56) References Cited

U.S. PATENT DOCUMENTS 5,655,614 A * 8/1997 Azar ..... E21B 10/04 175/404
6,394,202 B2 5/2002 Truax et al.
(Continued)

FOREIGN PATENT DOCUMENTS

| | | | | |
|---|---|---|---|---|
| CN | 102199992 A | | 9/2011 | |
| CN | 202081826 U | | 12/2011 | |
| CN | 202100203 U | | 1/2012 | |
| WO | WO 2008149240 A2 | * | 12/2008 | ..... E21B 10/485 |
| WO | WO2008149240 A2 | | 12/2008 | |

OTHER PUBLICATIONS

International Search Report and Written Opinion issued in PCT/US2014/055076 dated Sep. 11, 2014, 15 pages.
(Continued)

*Primary Examiner* — David J Bagnell
*Assistant Examiner* — Ronald R Runyan

(57) ABSTRACT

A fixed cutter drill bit may include a bit body having a bit centerline and a plurality of blades that extend radially from the bit body and are separated by a plurality of flow courses therebetween. Each of the plurality of blades is spaced a radial distance from the bit centerline to define a core-forming region. A plurality of cutting elements is disposed on the plurality of blades. The plurality of cutting elements comprises at least two coring cutting elements that are disposed on the plurality of blades and the at least two coring cutting elements are the radially innermost cutting elements on the plurality of blades.

14 Claims, 18 Drawing Sheets

(56) References Cited

U.S. PATENT DOCUMENTS

| | | | | |
|---|---|---|---|---|
| 7,703,559 | B2 | 4/2010 | Shen et al. | |
| 10,125,550 | B2 | 11/2018 | Velvaluri et al. | |
| 2010/0000800 | A1* | 1/2010 | Chen | E21B 10/55 175/430 |
| 2010/0101870 | A1 | 4/2010 | Shamburger | |
| 2010/0219001 | A1 | 9/2010 | Shen et al. | |
| 2011/0297454 | A1 | 12/2011 | Shen et al. | |
| 2012/0205163 | A1* | 8/2012 | Azar | E21B 10/26 175/428 |
| 2012/0234610 | A1 | 9/2012 | Azar et al. | |
| 2012/0273280 | A1 | 11/2012 | Zhang et al. | |
| 2012/0273281 | A1 | 11/2012 | Burhan et al. | |
| 2013/0020134 | A1 | 1/2013 | Azar et al. | |
| 2013/0199857 | A1 | 8/2013 | Schwefe et al. | |
| 2013/0220706 | A1* | 8/2013 | Azar | E21B 10/26 175/431 |
| 2013/0277120 | A1 | 10/2013 | Azar et al. | |
| 2014/0054094 | A1 | 2/2014 | Burhan et al. | |

OTHER PUBLICATIONS

First Office Action and Search Report issued in corresponding Chinese application CN201480058134.7 dated Jan. 4, 2017, 22 pages.

International Preliminary Report on Patentability issued in corresponding International Application PCT/US2014/055076 dated Mar. 15, 2016, 12 pages.

* cited by examiner

FIXED CUTTER DRILL BIT WITH MULTIPLE CUTTING ELEMENTS AT FIRST RADIAL POSITION TO CUT CORE

CROSS-REFERENCE TO RELATED APPLICATIONS

This application claims priority to U.S. Patent Application No. 61/876,630, filed on Sep. 11, 2013, which is herein incorporated by reference in its entirety.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocket formed in the surface of one of the blades. The cutting elements typically include a hard cutting layer of polycrystalline diamond (PCD) or other superabrasive materials such as thermally stable diamond or polycrystalline cubic boron nitride. These cutting elements are designed to shear formations that range from soft to medium hard. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional PDC bit 10 adapted for drilling through formations of rock to form a borehole is shown. PDC bit 10 generally includes a bit body 12, a shank 13, and a threaded connection or pin 14 for connecting the PDC bit 10 to a drill string (not shown) that is employed to rotate the bit in order to drill the borehole. Bit face 20 supports a cutting structure 15 and is formed on the end of the PDC bit 10 that is opposite pin end 16. PDC bit 10 further includes a central axis 11 about which PDC bit 10 rotates in the cutting direction represented by arrow 18.

Cutting structure 15 is provided on face 20 of PDC bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of PDC bit 10. However, secondary blades 34, 35, 36 extend radially along bit face 20 from a position that is distal bit axis 11 toward the periphery of PDC bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip **44*a* furthest from blade tops 42, 52 to which cutting element 40** is mounted.

Referring now to FIG. 3, a profile of PDC bit 10 is shown as it would appear with each of the blades (e.g., primary blades 31, 32, 33 and secondary blades 34, 35, 36) and cutting faces 44 of each of the cutting elements 40 rotated into a single rotated profile. In rotated profile view, blade tops 42, 52 of each of the blades 31-36 of PDC bit 10 form and define a combined or composite blade profile 39 that extends radially from bit axis 11 to outer radius 23 of PDC bit 10. Thus, as used herein, the phrase "composite blade profile" refers to the profile, extending from the bit axis to the outer radius of the bit, formed by the blade tops of each of the blades of a bit rotated into a single rotated profile (i.e., in rotated profile view).

Conventional composite blade profile 39 (most clearly shown in the right half of PDC bit 10 in FIG. 3) may generally be divided into three regions conventionally labeled cone region 24, shoulder region 25, and gage region 26. Cone region 24 comprises the radially innermost region of PDC bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional PDC bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line **27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., PDC bit 10), the composite blade profile includes a single convex shoulder region (e.g., convex shoulder region 25), and a single blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the PDC bit 10**.

For drilling harder formations, the mechanism for drilling changes from shearing to abrasion. For abrasive drilling, bits having fixed, abrasive elements are conventionally used. While PDC bits are known to be effective for drilling some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material (e.g., metal-matrix composites) to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

An example of a prior art diamond impregnated drill bit is shown in FIG. 4. The impregnated bit 70 includes a bit body 72 and a plurality of ribs 74 that are formed in the bit body 72. Ribs 74 may extend from a center of the bit body radially outward to the outer diameter of the bit body 72, and then axially downward, to define the diameter (or gage) of the impregnated bit 70. The ribs 74 are separated by channels 76 that enable drilling fluid to flow between and both clean and cool the ribs 74. The ribs 74 are typically arranged in groups 79 where a gap 78 between groups 79 is typically formed by removing or omitting at least a portion of a rib 74. The gaps 78, which may be referred to as "fluid courses," are positioned to provide additional flow channels for drilling fluid and to provide a passage for formation cuttings to travel past the drill bit 70 toward the surface of a wellbore (not shown).

Referring now to FIG. 5, an example of a prior art impregnated bit 80 in accordance with U.S. Pat. No. 6,394,202, which is assigned to the assignee of the present invention and is hereby incorporated by reference, is shown. In FIG. 5, the impregnated bit 80 comprises a shank 82 and a crown 84. Shank 82 is typically formed of steel and includes a threaded pin 86 for attachment to a drill string. Crown 84 has a cutting face 88 and outer side surface 89. According to one or more embodiments, crown 84 is formed by infiltrating a mass of tungsten-carbide powder impregnated with synthetic or natural diamond.

Crown 84 may include various surface features, such as raised ribs 74. Preferably, formers are included during the manufacturing process so that the infiltrated, diamond-impregnated crown includes a plurality of holes or sockets 85 that are sized and shaped to receive a corresponding plurality of diamond-impregnated inserts 83. Once crown 84 is formed, inserts 83 are mounted in the sockets 85 and affixed by any suitable method, such as brazing, adhesive, mechanical means such as interference fit, or the like. As shown in FIG. 5, the sockets 85 can be substantially perpendicular to the surface of the crown 84. As shown in FIG. 5, sockets 85 can each be substantially perpendicular to the surface of the crown 84. In this embodiment, the sockets 85 are inclined such that inserts 83 are oriented substantially in the direction of rotation of the bit, so as to enhance cutting.

Referring now to FIG. 6, an example of a cross-sectional view of a rib of a prior art impregnated drill bit is shown. The rib 74 has a profile 90 defining its general shape/geometry that may be divided into various segments: a cone region 92 (recessed central area), a nose region 94 (leading cutting edge of profile), a shoulder region 96 (beginning of outside diameter of bit), transition region 98 (transition between shoulder and vertical gage), and a gage region 99 (vertical region defining outer diameter of bit). The primary cutting portion of the rib 74 includes cone region 92, nose region 94, and shoulder region 96, whereas gage region 99 is primarily responsible for maintaining the hole size.

Without regard to the type of bit, the cost of drilling a borehole is proportional to the length of time it takes to drill the borehole to the desired depth and location. The drilling time, in turn, is greatly affected by the number of times the drill bit is changed in order to reach the targeted formation. This is the case because each time the bit is changed, the entire drill string, which may be miles long, is retrieved from the borehole section by section. Once the drill string has been retrieved and the new bit installed, the bit is lowered to the bottom of the borehole on the drill string, which again is constructed section by section. This process, known as a "trip" of the drill string, involves considerable time, effort, and expense. Accordingly, it may be desirable to employ drill bits that will drill faster and longer and that are usable over a wider range of differing formation hardnesses and applications.

The length of time that a drill bit may be employed before it is changed depends upon its rate of penetration ("ROP"), as well as its durability or ability to maintain a high or acceptable ROP. Specifically, ROP is the rate that a drill bit penetrates a given subterranean formation. ROP is typically measured in feet per hour. There is an ongoing effort to optimize the design of drill bits to more rapidly drill specific formations so as to reduce drilling costs, which are affected by ROP.

Once a desired formation is reached in the borehole, a core sample of the formation may be extracted for analysis. Conventionally, a hollow coring bit is employed to extract a core sample from the formation. Once the core sample has been transported from the borehole to the surface, the sample may be used to analyze and test, for example, permeability, porosity, composition, or other geological properties of the formation.

Regardless of the type of drill bit employed to drill the formation, conventional coring methods involve retrieval of the drill string from the borehole, replacement of the drill bit with a coring bit, and lowering of the coring bit into the borehole on the drill string in order to retrieve a core sample, which is then taken along the path of the borehole to reach the surface for analysis. That is, conventional coring methods involve tripping the drill string, and thus considerable time, effort, and expense.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a fixed cutter drill bit that includes a bit body having a bit centerline; a plurality of blades extending radially from the bit body and separated by a plurality of flow courses therebetween, each of the plurality of blades being spaced a radial distance from the bit centerline to define a core-forming region; a plurality of cutting elements disposed on the plurality of blades, the plurality of cutting elements comprising at least two coring cutting elements disposed on the plurality of blades, the at least two coring cutting elements being the radially innermost cutting elements on the plurality of blades.

In another aspect, embodiments disclosed herein relate to a fixed cutter drill bit that includes a bit body having a bit centerline; a plurality of blades extending radially from the bit body and separated by a plurality of flow courses therebetween, each of the plurality of blades being spaced a radial distance from the bit centerline to define a core-forming region; a plurality of cutting elements disposed on the plurality of blades, the plurality of cutting elements comprising at least two coring cutting elements disposed on the plurality of blades, the at least two coring cutting elements being the radially innermost cutting elements on the plurality of blades; wherein the at least two coring cutting elements are aligned to have a cutting zone that extends to substantially the same radial distance from the bit centerline or axial height.

In yet another aspect, embodiments disclosed herein relate to a fixed cutter drill bit that includes a bit body having a bit centerline; a plurality of blades extending radially from the bit body and separated by a plurality of flow courses therebetween, each of the plurality of blades being spaced a radial distance from the bit centerline to define a core-forming region; a plurality of cutting elements disposed on the plurality of blades, the plurality of cutting elements comprising at least two coring cutting elements disposed on the plurality of blades, the at least two coring cutting elements being the radially innermost cutting elements on the plurality of blades; wherein an axial centerline of each of the at least two coring cutting elements are at substantially the same radial distance from the bit centerline.

In yet another aspect, embodiments disclosed herein relate to a fixed cutter drill bit that includes a bit body having a bit centerline; a plurality of blades extending radially from the bit body and separated by a plurality of flow courses therebetween, each of the plurality of blades being spaced a radial distance from the bit centerline to define a core-forming region; a plurality of cutting elements disposed on the plurality of blades, the plurality of cutting elements comprising: a first coring cutting elements disposed on one of the plurality of blades, the first coring cutting element being the radially most interior of the plurality of cutting elements, wherein the first coring cutting element comprises a core-cutting quadrant that is defined as the region between a first tangent of the first coring cutting element's cutting edge that is parallel to the bit centerline, a second tangent of the first coring cutting element's cutting edge that is perpendicular to the bit centerline, and an arc length of the first coring cutting element's cutting edge between the first and second tangent; and a second coring cutting element disposed on one of the plurality of blades, the second coring cutting element having a cutting zone that is at least partially within the core-cutting quadrant or overlapping the arc length defining the core-cutting quadrant.

Other aspects and advantages of the claimed subject matter will be apparent from the following description and the appended claims.

DETAILED DESCRIPTION

Embodiments of the present disclosure will be described below with reference to the figures. In one aspect, embodiments disclosed herein relate to fixed cutter drill bits for obtaining core sample fragments from a subterranean formation. In particular, embodiments disclosed herein relate to use of multiple cutting elements on the fixed cutter drill bit that cut and form the core sample fragments.

Figure 7:
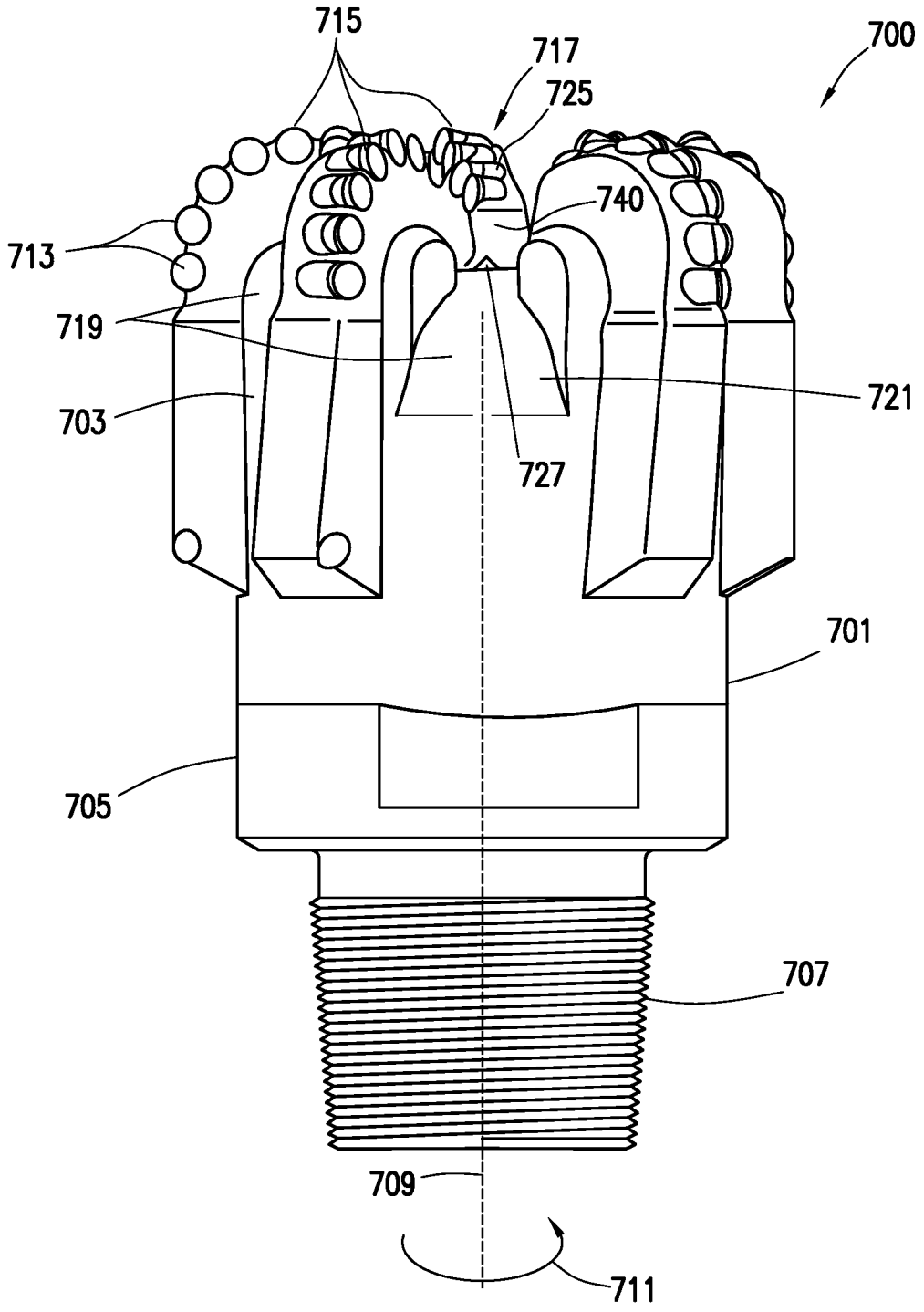
FIGS. 7-8 shows an embodiment of a fixed cutter drill bit.

Referring now to FIG. 7, a perspective view of a drill bit is shown. As shown, the drill bit is a PDC bit 700 that includes a bit body 701, a shank 705, and a pin 707. Pin 707 is used to secure PDC bit 700 to the lower end of a drill string (not shown). PDC bit 700 further includes a bit centerline 709 about which PDC bit 700 rotates in the cutting direction represented by arrow 711. According to one or more embodiments of the present disclosure, bit body 701 extends through bit centerline 709 and smoothly transitions into and between flow courses 719, which are described in further detail below.

When PDC bit 700 is secured to the drill string, rotating the drill string causes PDC bit 700 to rotate and penetrate and cut through a subterranean formation using a plurality of cutting elements 713, which are described in further detail below. As PDC bit 700 penetrates and cuts through the subterranean formation, a wellbore is formed.

As shown in FIG. 7, bit body 701 of PDC bit 700 supports a plurality of blades 715. Plurality of blades 715 are formed on an end of PDC bit 700 that is opposite pin 707. As shown, plurality of blades 715 extend radially along bit body 701 and then axially along a portion of the periphery of PDC bit 700. According to one or more embodiments of the present disclosure, one of the plurality of blades is a coring blade 717, which is described in further detail below. Plurality of blades 715 are separated by a plurality of flow courses 719, which enable drilling fluid to flow between and both clean and cool plurality of blades 715 during drilling. In one or more embodiments of the present disclosure, one of the plurality of flow courses 719 may optionally be an evacuation slot 721, which is described in further detail below.

As further shown in FIG. 7, each of the plurality of blades 715 includes plurality of cutting elements 713 disposed thereon. As shown, plurality of cutting elements 713 are arranged adjacent one another in a radially extending row proximal the leading edge of each of the plurality of blades 715. Plurality of cutting elements 713 may have a substantially planar cutting face in order to achieve a shearing cutting action while drilling a formation. In other embodiments, any one of the plurality of cutting elements 713 may be rotatable cutting elements, such as those disclosed in in U.S. Pat. No. 7,703,559, U.S. Patent Publication No. 2010/0219001, 2011/0297454, 2012/0273281, 2012/0273280, and 2014/0054094, all of which are assigned to the present assignee and herein incorporated by reference in their entirety. In other embodiments, any one of the plurality of cutting elements 713 may be "non-planar cutting elements," such as those described in U.S. Patent Application Nos. 2013/0277120, 2012/0205163, 2012/0234610, and 2013/0020134, all of which are assigned to the present assignee and herein incorporated by reference in their entirety.

Figure 8:
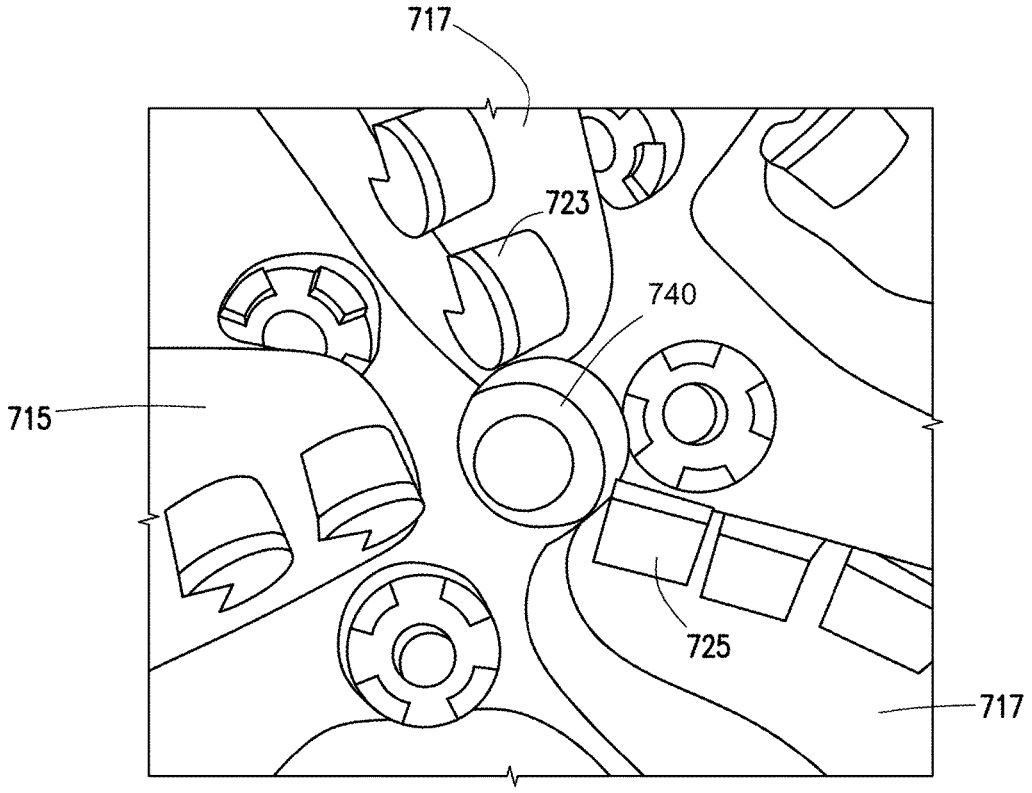

According to one or more embodiments of the present disclosure, at least two of the radially most interior cutting elements 713 is a coring cutting element 725 disposed on coring blade 717. As used herein, the terms "coring cutting element" and "coring blade" refer to a particular cutting element and blade that cuts the formation in such a manner that a core sample fragment is formed. In one or more embodiments, other optional features may be included to help break the core for evacuation through the annulus. Further, as mentioned, bits of the present disclosure may include at least two coring cutting elements. For example, referring now to FIG. 8, a partial view of a fixed cutter bit having two coring cutting elements is shown. The bit 700 includes a plurality of blades 715, two of which are coring blades 717. On coring blades 717, coring cutting elements 725 are included. As illustrated, coring cutting elements 725 cut a cylindrical core 740. Further, according to embodiments of the present disclosure, such core 740 is cut using at least one coring cutting element 725 that also cuts the bottom hole (advancing the formation of the wellbore). In some embodiments, the back-up coring cutting element 725 does not necessarily cut both the core and bottom hole, but can cut only the core sidewall, in one or more embodiments.

Figure 9:
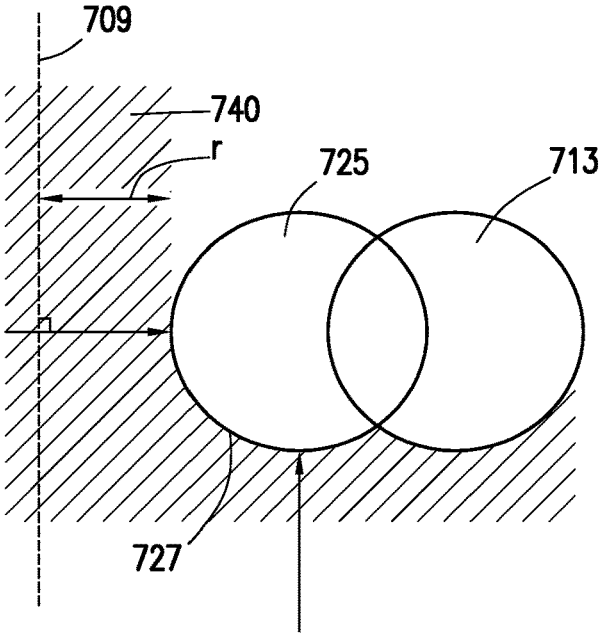
FIGS. 9-22 show embodiments of coring cutting elements of the present disclosure.

As used herein, the "core" is a substantially cylindrical portion of the formation that is allowed to remain uncut axially above the cutting profile of cutting elements and adjacent the bit center. As illustrated in FIG. 9, the shape of core 740 is defined by a portion of cutting edge 727 of coring cutting element 725. The cutting edge may generally be described as the active cutting zone of the coring cutting element. That is, it is the portion of the cutting element that cuts the formation when the bit engages with the formation. Cutting edge may refer to an edge formed between two intersecting surfaces, whereas a cutting zone may more generally describe the region (and is not limited by two intersecting surfaces) in cases where cutting elements of other shapes may be used. As mentioned above, coring cutting elements 725 are the radially most interior cutting elements 713 on blades (not shown). The portion of cutting edge 727 that forms the core extends an arc length (indicated by arrows) of approximately 90 degrees from the radially innermost extent of coring cutting element to the point where the tangent to the cutting edge is substantially perpendicular with the bit centerline. The core diameter is dependent on the radial distance from bit centerline 709 to the radially innermost extent of coring cutting element 725. The point where the tangent to the cutting edge is perpendicular to the bit centerline is also the point at which the coring cutting element also cuts the bottom hole.

As mentioned above, bits formed in accordance with the present disclosure do not include a single coring cutting element, but rather, the bits are formed with two or more coring cutting elements. Such coring cutting elements may be located on differing blades. In one or more embodiments, the two (or more) cutting elements may be "plural" as that term is known in the art. Conventionally, a plural set bit includes more than one cutting element at at least approximately one radial position with respect to the bit axis or centerline. Expressed in another way, at least one cutting element includes therefor a "backup" cutting element disposed at substantially the same radial position with respect to the bit axis or centerline. In conventional plural sets, the radial positions of each of the cutting elements are selected so that the cutting elements, in the aggregate, provide substantially full coverage, similar to a single set bit (where each cutting element has a unique radial position). However, according to one or more embodiments of the present disclosure, less than all cutting element locations (i.e., radial positions) are plural. For example, in particular embodiments, the most radially interior cutting element (a coring cutting element) is plural, and no other cutting element is plural. Such embodiments may include cutting elements having substantially the same cutting profile when rotated into the same plane.

Figure 10:
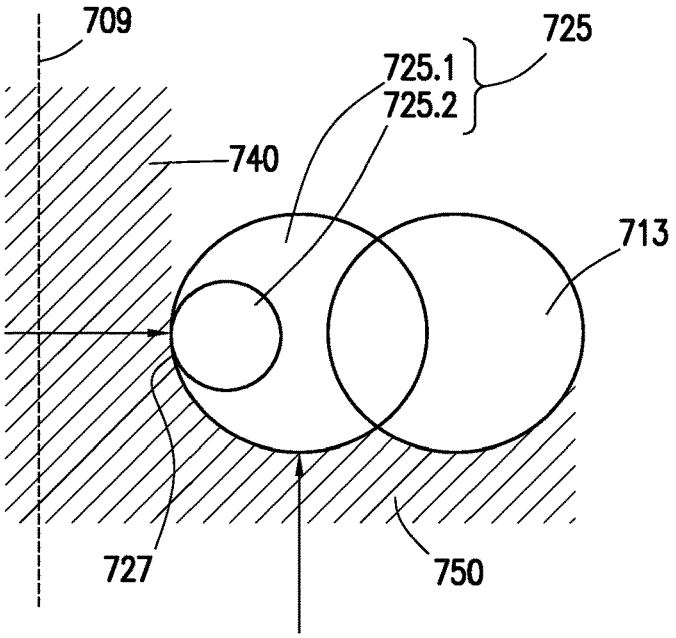

In accordance with one or more embodiments, a second coring cutting element has a cutting edge that overlaps the cutting edge along the arc illustrated in FIG. 9. As mentioned above, such overlap may include a plural coring cutting element, where substantially the entire cutting edges of the two coring cutting elements overlap (and share tangent lines along the entire cutting edge). However, the present disclosure also considers embodiments in which less than the entire cutting edge overlaps, but for which share a tangent (at at least a point of tangency). For example, a less than total overlap may result from the use of coring cutting elements of differing sizes. Referring now to FIG. 10, one example of such an embodiment is shown. In the illustrated embodiment, the shape of core 740 is defined by overlapping coring cutting elements 725. As illustrated, there are two coring cutting elements 725.1 and 725.2 that are the two radially most interior cutting elements 713. Coring cutting element 725.1 has a larger diameter than coring cutting element 725.2, and the cutting edges 727 overlap along the sidewall of core 740. Specifically, the cutting edges 727 of coring cutting elements 725 extent to substantially the same radial distance from the bit centerline 709, thereby defining the radius/diameter of the core 740. In this embodiment, coring cutting element 725.1 cuts both the core 740 and bottom hole 750, while coring cutting element 725.2 only cuts the core 740. Further, the two coring cutting elements 725 have cutting edges that extend to substantially the same radial distance from the bit centerline.

Figure 11:
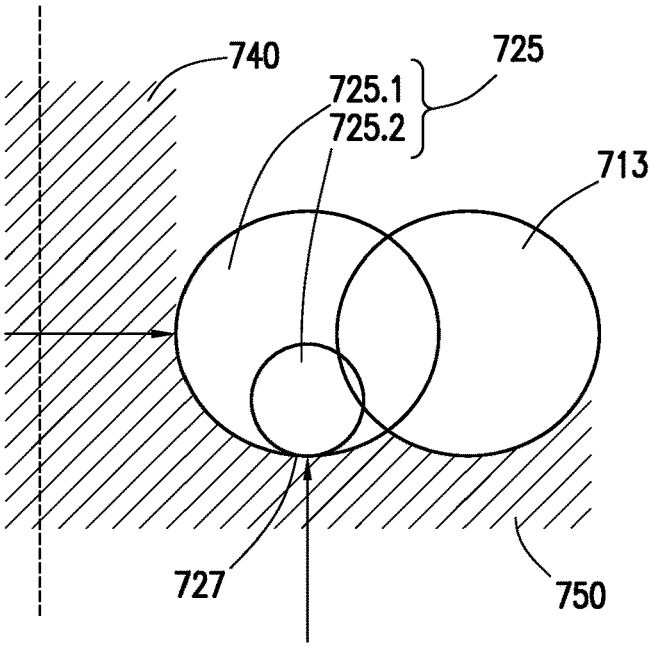

Another embodiment showing cutting edge overlap is shown in FIG. 11. In the illustrated embodiment, the shape of core 740 is defined by overlapping coring cutting elements 725. As illustrated, there are two coring cutting elements 725.1 and 725.2 that are the two radially most interior cutting elements 713. Coring cutting element 725.1 has a larger diameter than coring cutting element 725.2, and the cutting edges 727 overlap at the outer extent of the base of core 740 (where the core transitions from a substantially cylindrical sidewall to the bottom hole). In this embodiment, the cutting edge 727 of coring cutting elements 725.1 extends furthest to form the closest radial distance from the bit centerline (of cutting elements 713), thereby defining the radius/diameter of the core 740; whereas coring cutting element 725.2 has a greater radial distance, yet still overlaps along a portion of the core cutting arc length of coring cutting element 725.1. In this embodiment, the two coring cutting elements 725 have cutting edges 727 that extend to substantially the same axial height.

Figure 12:
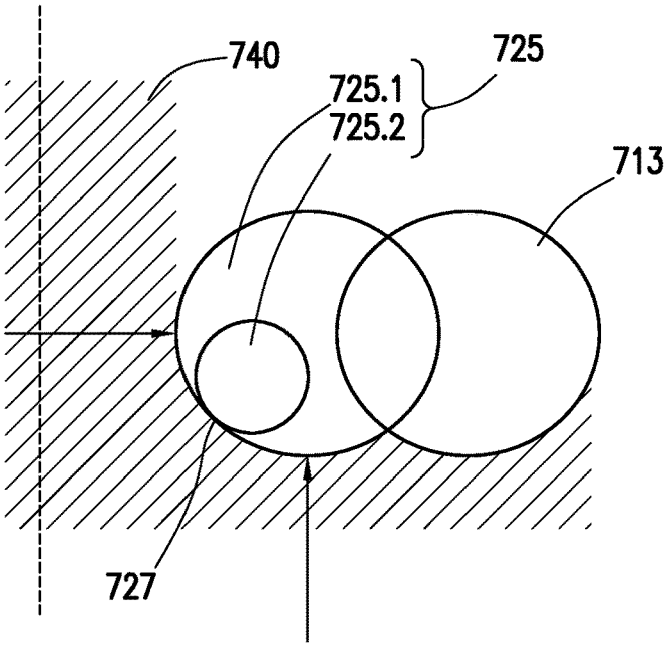

Yet another embodiment showing cutting edge overlap is shown in FIG. 12. In the illustrated embodiment, the shape of core 740 is defined by overlapping coring cutting elements 725. As illustrated, there are two coring cutting elements 725.1 and 725.2 that are the two radially most interior cutting elements 713. Coring cutting element 725.1 has a larger diameter than coring cutting element 725.2, and the cutting edges 727 overlap along core 740 transition from sidewall to base. In this embodiment, the cutting edge 727 of coring cutting elements 725.1 extends furthest to form the closest radial distance from the bit centerline (of cutting elements 713), thereby defining the radius/diameter of the core 740; whereas coring cutting element 725.2 has a greater radial distance, yet still overlaps along a portion of the core cutting arc length of coring cutting element 725.1.

Figure 14:
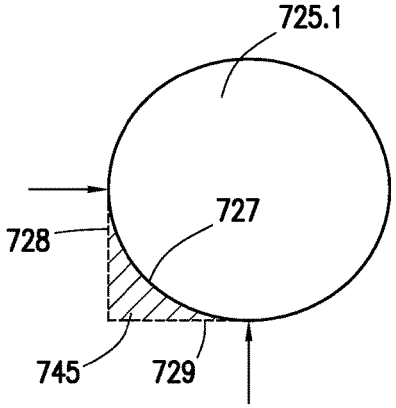
Figure 15:
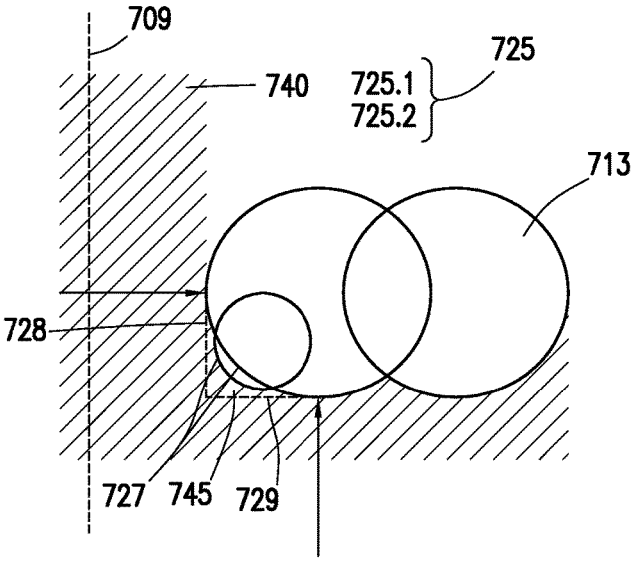

As illustrated in FIGS. 10-12, the two most radially interior cutting elements possess at least some overlap of their cutting edge along the arc defining the core (and thus share a tangent at that overlap); however, it is also within the scope of the present disclosure, that the second coring cutting element may have a cutting edge that does not overlap (or share a tangent) with the first coring cutting element. For example, referring now to FIG. 13-14, a second coring element 725.2 may have a cutting edge 727 that falls within a core-cutting quadrant 745. The core-cutting quadrant may be defined as the region between a first tangent 728 of the first coring cutting element's cutting edge 727 that is parallel to the bit centerline, a second tangent 729 of the first coring cutting element's cutting edge 727 that is perpendicular to the bit centerline, and an arc length (illustrated between the arrows) of the first coring cutting element's cutting edge 727 between the first and second tangent 728, 729. In this illustrated embodiment, the two coring cutting elements 725 have cutting edges that extend to substantially the same radial distance from the bit centerline, as well as substantially the same axial height. However, the present disclosure is not limited, as illustrated in FIG. 15, which also shows a second coring cutting element 725.2 having a cutting edge 727 that falls within a core-cutting region 745 defined by the first coring cutting element 725.1, but that is not at the same axial height or radial distance from bit center line 709.

Figure 16:
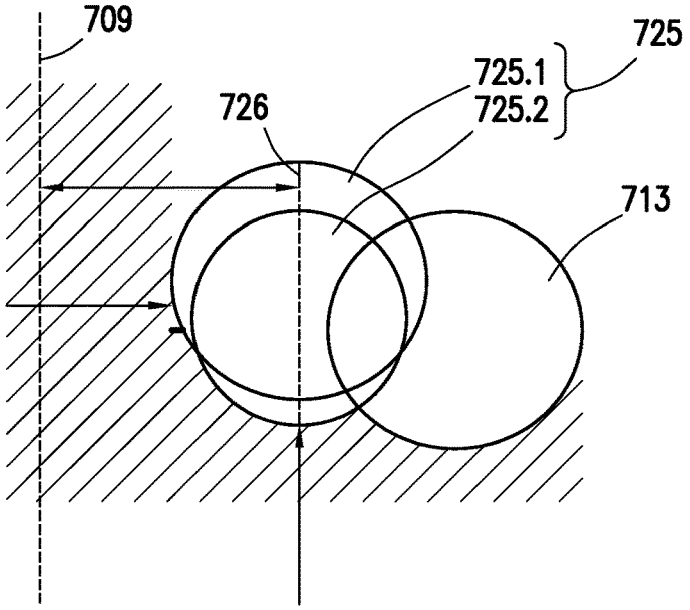

Referring now to FIG. 16, yet another embodiment is shown. In this illustrated embodiment, the first coring cutting element 725.1 and the second coring cutting element 725.2 each have axial centerline 726 that is at substantially the same radial distance from the bit centerline 709. That is, when rotated into a single plane, the axial centerlines overlap, as illustrated. Such axial centerline overlap is also present in the embodiment illustrated in FIG. 11, for example. However, unlike FIG. 11, the second coring cutting element 725.2 illustrated in FIG. 16 does not have cutting edge that overlaps (or shares a tangent) with the first coring cutting element 725.1 because the second coring cutting element 725.2 extends axially lower than the first coring cutting element 725.1. Similar to other embodiments illustrated, the first cutting element 725.1 and second cutting element 725.2 have differing diameters; however, the same diameters may also be used. Further, while the smaller cutting element, second coring cutting element 725.2 is shown as extending axially lower than the larger, first coring cutting element 725.1, the reverse may also be true.

Figure 13:
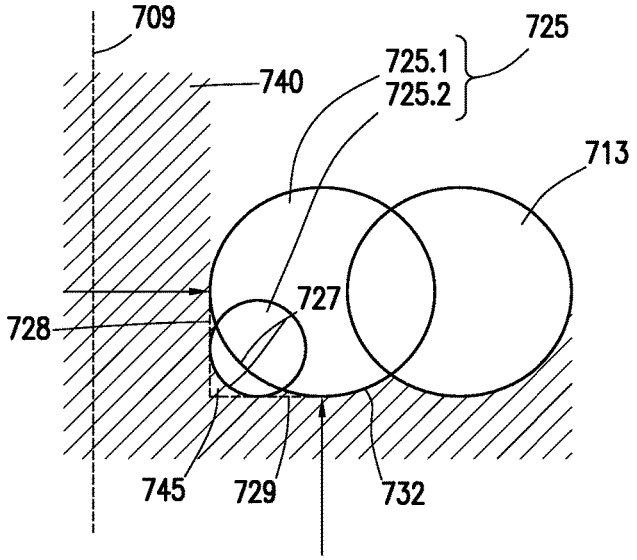

In each of the illustrated embodiments, one of the two coring cutting elements is also illustrated as being oriented and disposed on a blade so as to be able cut a portion of the bottom hole. Referring to FIG. 13-14, for ease of explanation, the bottom hole is defined as being radially outside the point (indicated by the arrow) on the cutting edge 727 where the tangent 729 to the cutting edge 727 is perpendicular to the bit centerline. Thus, core-cutting quadrant 745 is identified in FIG. 14, and is radially inside of the relevant tangent point, whereas the bottom-hole cutting portion 732 is the cutting edge 727 arc that is radially outside of the core-cutting quadrant 745.

Figure 26:
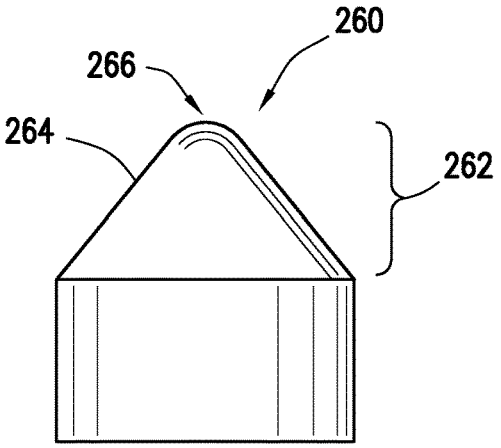
FIG. 26 shows a side view of a conical cutting element.
Figure 27:
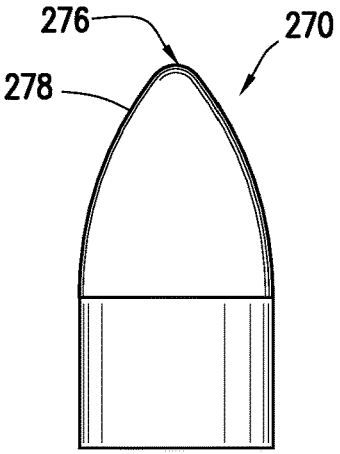
FIG. 27 shows a side view of a pointed cutting element having a convex side surface.
Figure 28:
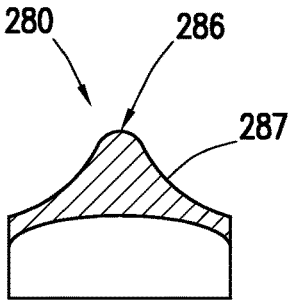
FIG. 28 shows a cross-sectional view of a pointed cutting element having a concave side surface

For example, FIGS. 17-22 illustrate the embodiments shown in FIGS. 10-16, where one of the coring cutters has been replaced with a coring cutting element having a non-planar cutting face. In the illustrated embodiments, one of the coring cutting elements is a conventional cutter (with a substantially planar cutting face) and one of the coring cutting elements has a non-planar cutting surface. For example, such non-planar cutting surfaces may include those cutting elements having a generally pointed cutting end, i.e., terminating in an apex, which may include cutting elements having a conical cutting end (shown in FIG. 26) or a bullet cutting element (shown in FIG. 27), for example. As used herein, the term "conical cutting elements" refers to cutting elements 260 having a generally conical cutting end 262 (including either right cones or oblique cones), i.e., a conical side wall 264 that terminates in a rounded apex 266, as shown in FIG. 26. Unlike geometric cones that terminate at a sharp point apex, the conical cutting elements of the present disclosure possess an apex having curvature between the side surfaces and the apex. Further, in one or more embodiments, a bullet cutting element 270 may be used. The term "bullet cutting element" refers to cutting element having, instead of a generally conical side surface, a generally convex side surface 278 terminated in a rounded apex 276. In one or more embodiments, the apex 276 has a substantially smaller radius of curvature than the convex side surface 278. However, it is also intended that the non-planar cutting elements 280 of the present disclosure may also include other shapes, including, for example, a concave side surface 287 terminating in a rounded apex 286, shown in FIG. 28. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180 degree angle, such as for example ranging from about 120 to less than 180 degrees). Further, in one or more embodiments, the non-planar cutting elements may include any shape having an cutting end extending above a grip or base region, where the cutting end extends a height that is at least 0.25 times the diameter of the cutting element, or at least 0.3, 0.4, 0.5 or 0.6 times the diameter in one or more other embodiments.

Referring back to FIG. 17, in the illustrated embodiment, the shape of core 1740 is defined by overlapping coring cutting elements 1725. As illustrated, there are two coring cutting elements 1725.1 and 1725.2 that are the two radially most interior cutting elements 713. Coring cutting element 1725.1 is a shear cutter having a substantially planar cutting face, and coring cutting element 2725.2 is a conical cutting element (although other non-planar cutting surfaces may be used). The active cutting zone 1727 (an edge in the case of a shear cutter and the apex in the case of a non-planar cutting element) overlap along the sidewall of core 740. Specifically, the active cutting zones 1727 of coring cutting elements 1725 extent to substantially the same radial distance from the bit centerline 1709, thereby defining the radius/ diameter of the core 1740. In this embodiment, coring cutting element 1725.1 cuts both the core 1740 and bottom hole 1750, while coring cutting element 1725.2 only cuts the core 1740. Further, the two coring cutting elements 1725 have active cutting zone 1727 that extend to substantially the same radial distance from the bit centerline.

Figure 18:
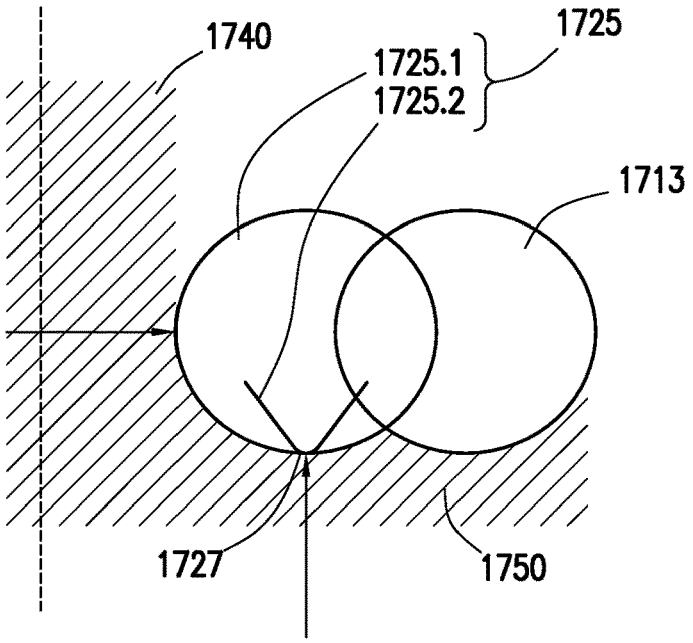

Another embodiment showing cutting edge overlap is shown in FIG. 18. In the illustrated embodiment, the shape of core 1740 is defined by overlapping coring cutting elements 1725. As illustrated, there are two coring cutting elements 1725.1 and 1725.2 that are the two radially most interior cutting elements 1713. Coring cutting element 1725.1 is a shear cutter having a substantially planar cutting face, and coring cutting element 1725.2 is a conical cutting element (although other non-planar cutting surfaces may be used). The active cutting zone 1727 (an edge in the case of a shear cutter and the apex in the case of a non-planar cutting element) overlap at the outer extent of the base of core 1740 (where the core transitions from a substantially cylindrical sidewall to the bottom hole). In this embodiment, the active cutting zone 1727 of coring cutting elements 1725.1 extends furthest to form the closest radial distance from the bit centerline (of cutting elements 1713), thereby defining the radius/diameter of the core 1740; whereas coring cutting element 1725.2 has a greater radial distance, yet still overlaps along a portion of the core cutting arc length of coring cutting element 1725.1. In this embodiment, the two coring cutting elements 1725 have active cutting zones 1727 that extend to substantially the same axial height.

Figure 19:
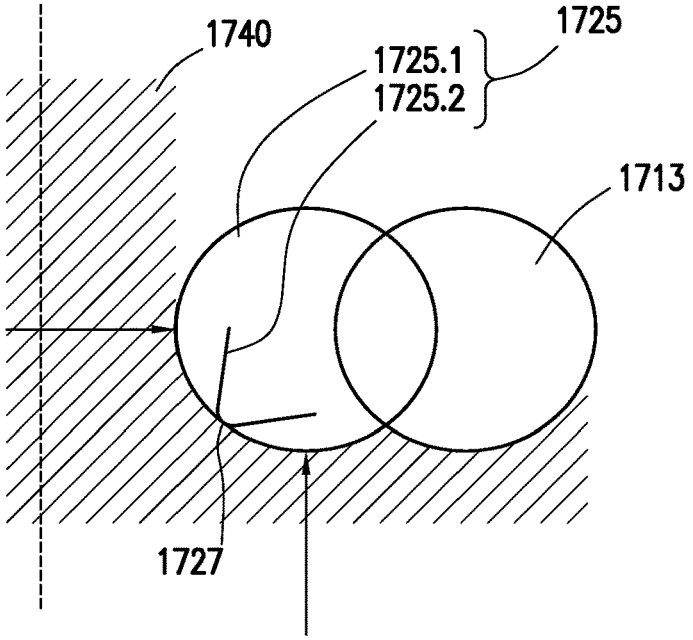
Figure 20:
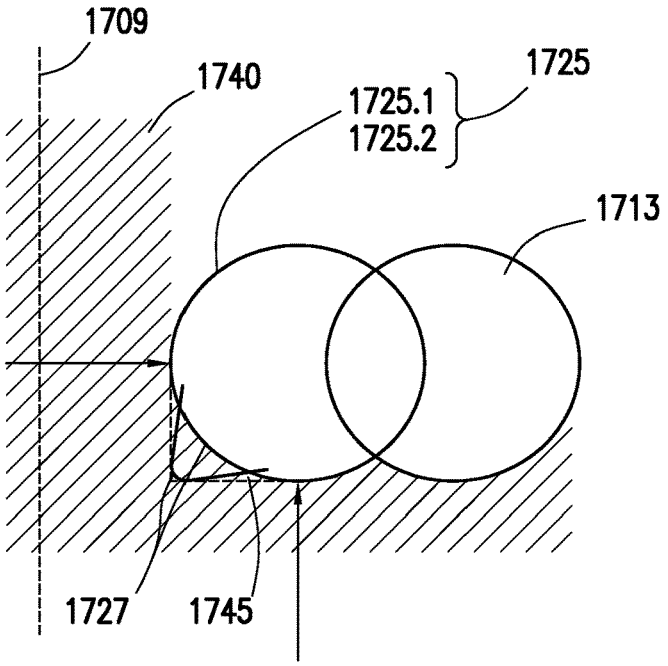

Yet another embodiment showing cutting edge overlap is shown in FIG. 19. In the illustrated embodiment, the shape of core 1740 is defined by overlapping coring cutting elements 1725. As illustrated, there are two coring cutting elements 1725.1 and 1725.2 that are the two radially most interior cutting elements 1713. Coring cutting element 1725.1 is a shear cutter having a substantially planar cutting face, and coring cutting element 1725.2 is a conical cutting element (although other non-planar cutting surfaces may be used). The active cutting zones 1727 overlap along core 1740 transition from sidewall to base. In this embodiment, the cutting edge 1727 of coring cutting elements 1725.1 extends furthest to form the closest radial distance from the bit centerline (of cutting elements 1713), thereby defining the radius/diameter of the core 1740; whereas coring cutting element 1725.2 has a greater radial distance, yet still overlaps along a portion of the core cutting arc length of coring cutting element 1725.1.

Figure 17:
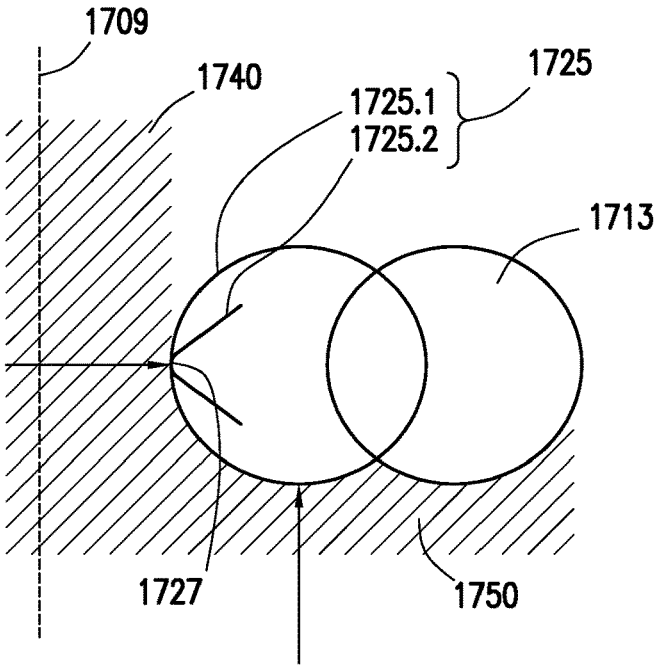
Figure 21:
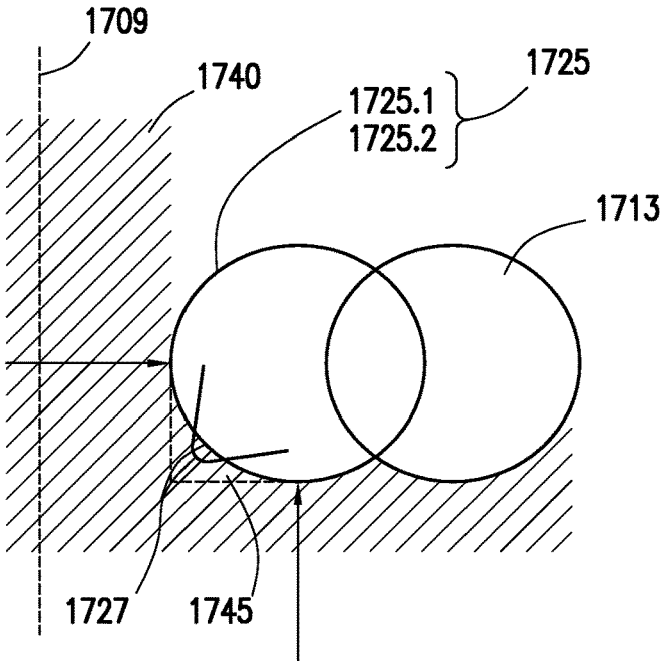

As illustrated in FIGS. 17-19, the two most radially interior cutting elements possess at least some overlap of their active cutting zone along the arc defining the core (and thus share a tangent at that overlap); however, it is also within the scope of the present disclosure, that the non-planar coring cutting element may have apex that does not overlap (or share a tangent) with the first coring cutter. For example, referring now to FIG. 20, a second coring element 1725.2 may have a cutting zone 1727 that falls within a core-cutting quadrant 1745 (as that term has been defined above with respect to FIG. 14). In this illustrated embodiment, the two coring cutting elements 1725 have cutting edges that extend to substantially the same radial distance from the bit centerline, as well as substantially the same axial height. However, the present disclosure is not limited, as illustrated in FIG. 21, which also shows a second coring cutting element 1725.2 having a cutting zone 1727 that falls within a core-cutting region 1745 defined by the first coring cutting element 1725.1, but that is not at the same axial height or radial distance from bit center line 1709.

Figure 22:
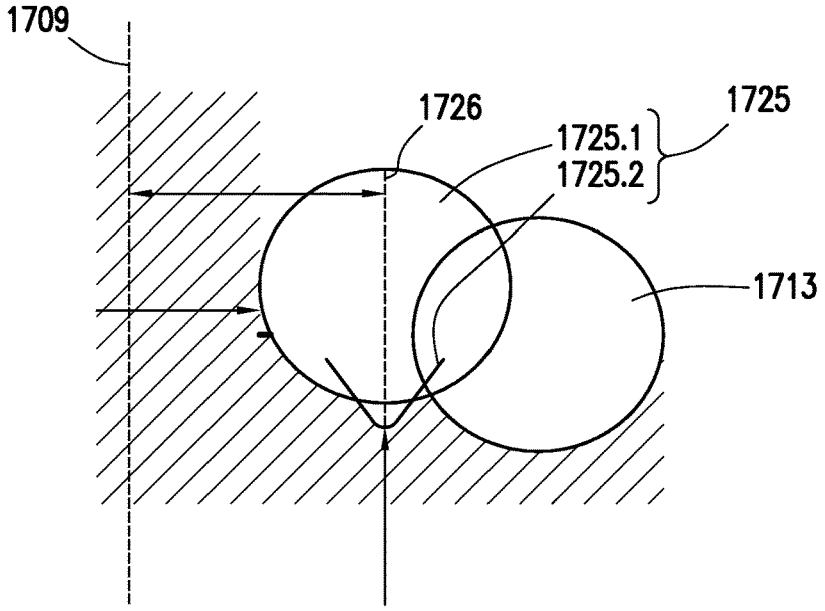

Referring now to FIG. 22, yet another embodiment is shown. In this illustrated embodiment, the first coring cutting element 1725.1 and the second coring cutting element 1725.2 each have axial centerline 1726 that is at substantially the same radial distance from the bit centerline 1709. That is, when rotated into a single plane, the axial centerlines overlap, as illustrated. Such axial centerline overlap is also present in the embodiment illustrated in FIG. 18, for example. However, unlike FIG. 18, the second coring cutting element 1725.2 illustrated in FIG. 22 does not have cutting zone that overlaps (or shares a tangent) with the first coring cutting element 1725.1 because the second coring cutting element 1725.2 extends axially lower than the first coring cutting element 1725.1. Similar to other embodiments illustrated, the first cutting element 1725.1 is a shear cutter and second cutting element 1725.2 has a non-planar cutting surface. Further, while the non-planar, second coring cutting element 1725.2 is shown as extending axially lower than the coring cutter 1725.1, the reverse may also be true.

Figure 1:
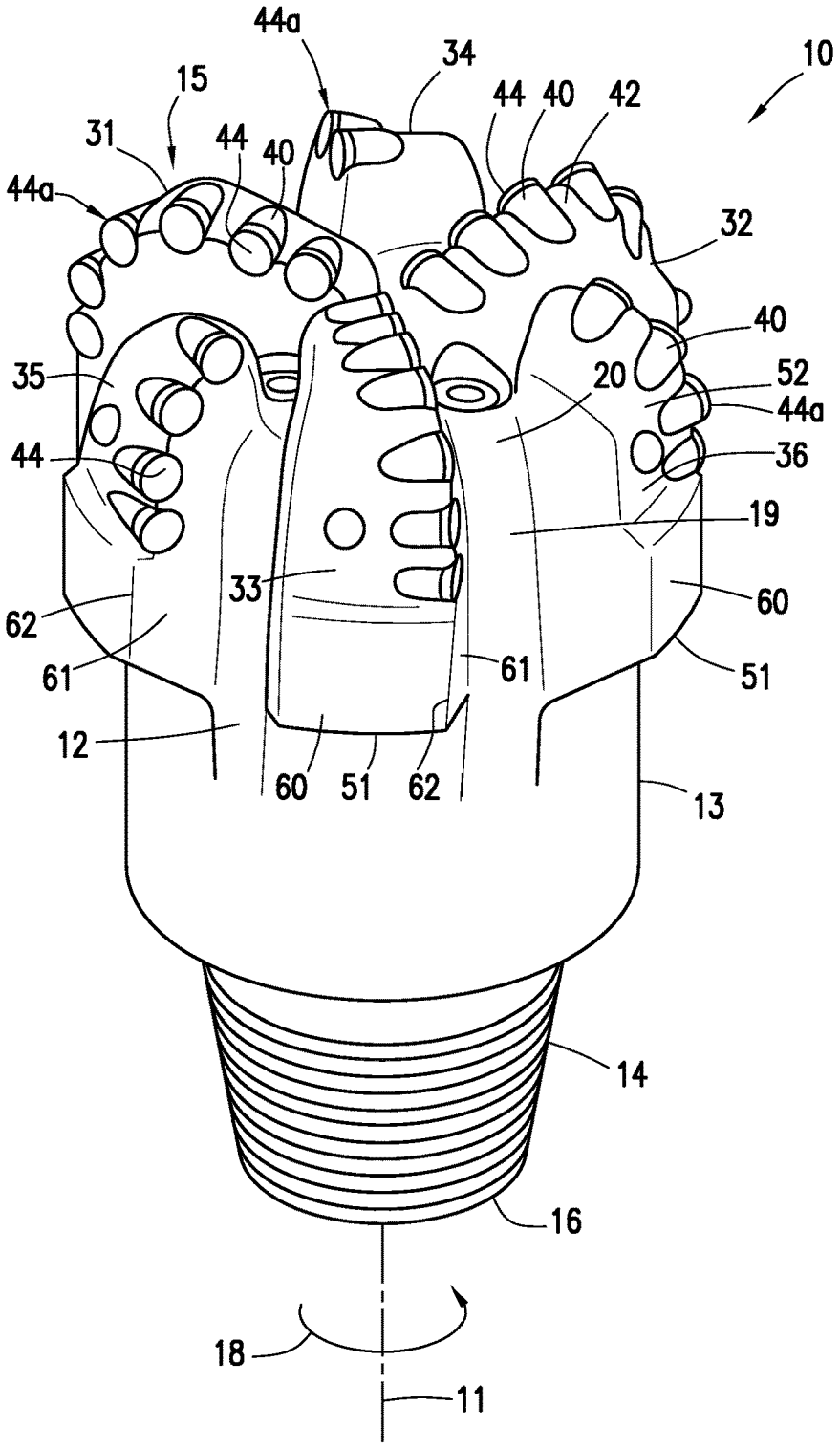
FIG. 1 (PRIOR ART)
FIG. 1 shows a perspective view of a conventional PDC drill bit.
Figure 2:
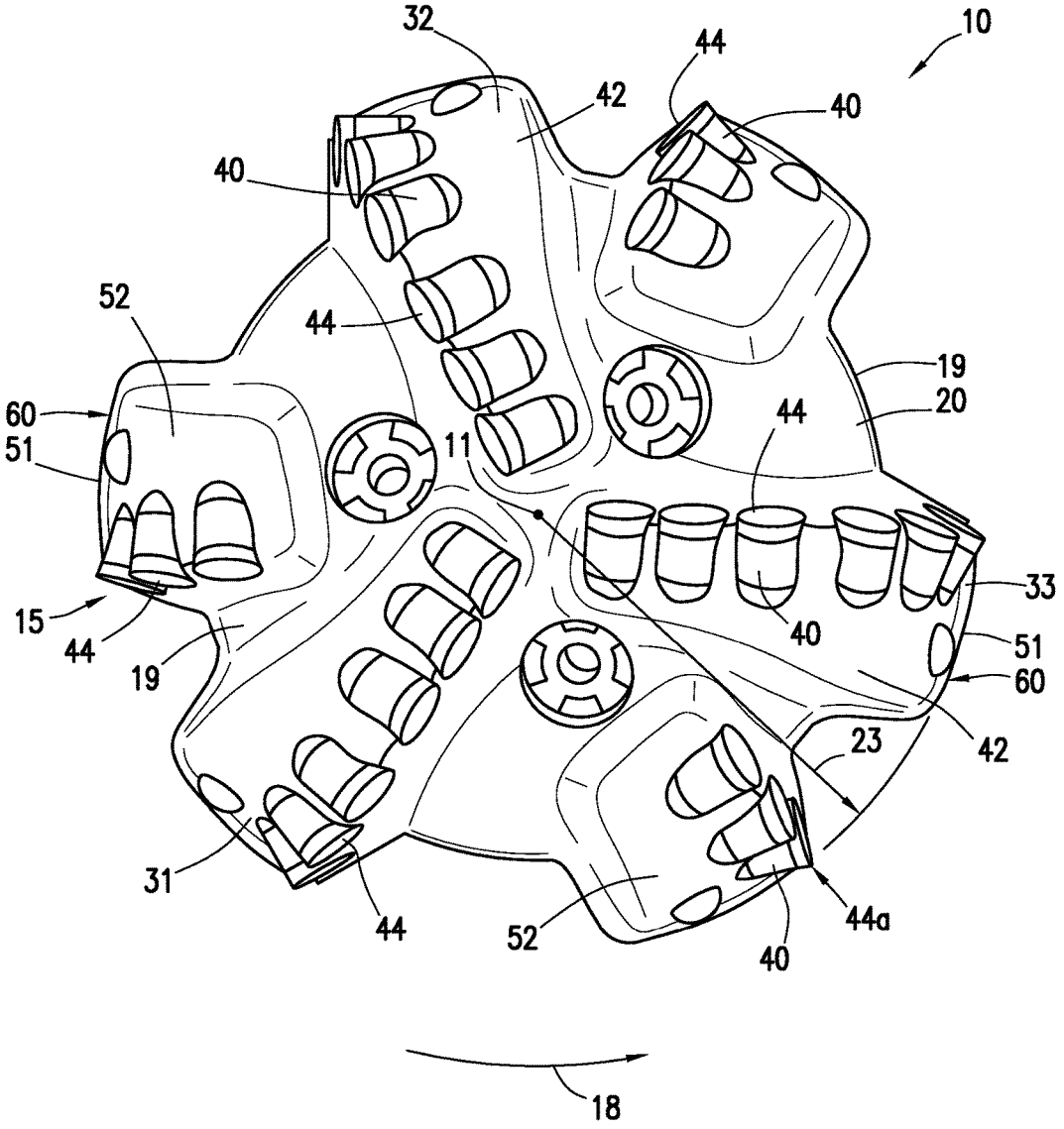
FIG. 2 (PRIOR ART)
FIG. 2 shows a top view of a conventional PDC drill bit.
Figure 3:
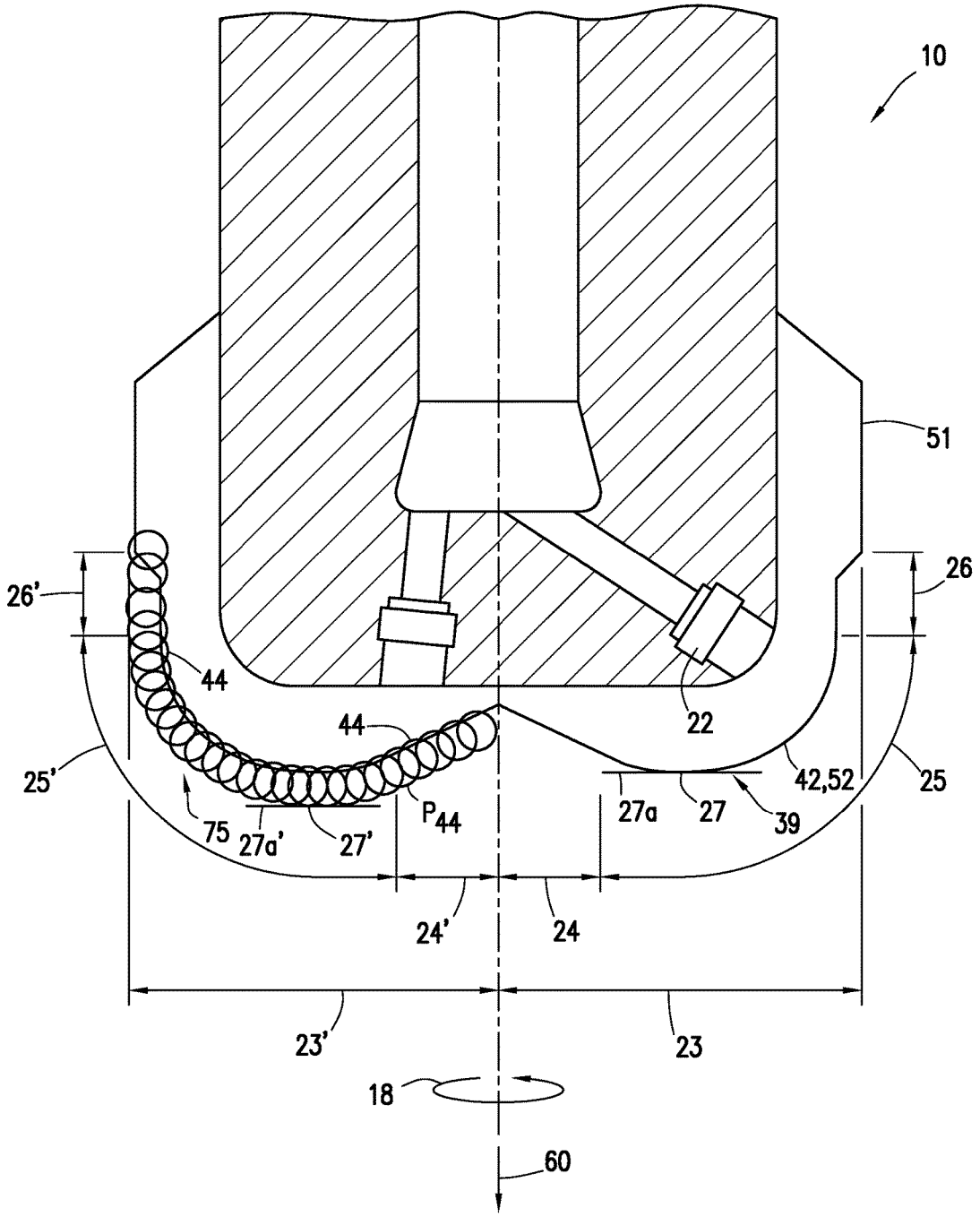
FIG. 3 (PRIOR ART)
FIG. 3 shows a cross-sectional view of a conventional PDC drill bit.
Figure 4:
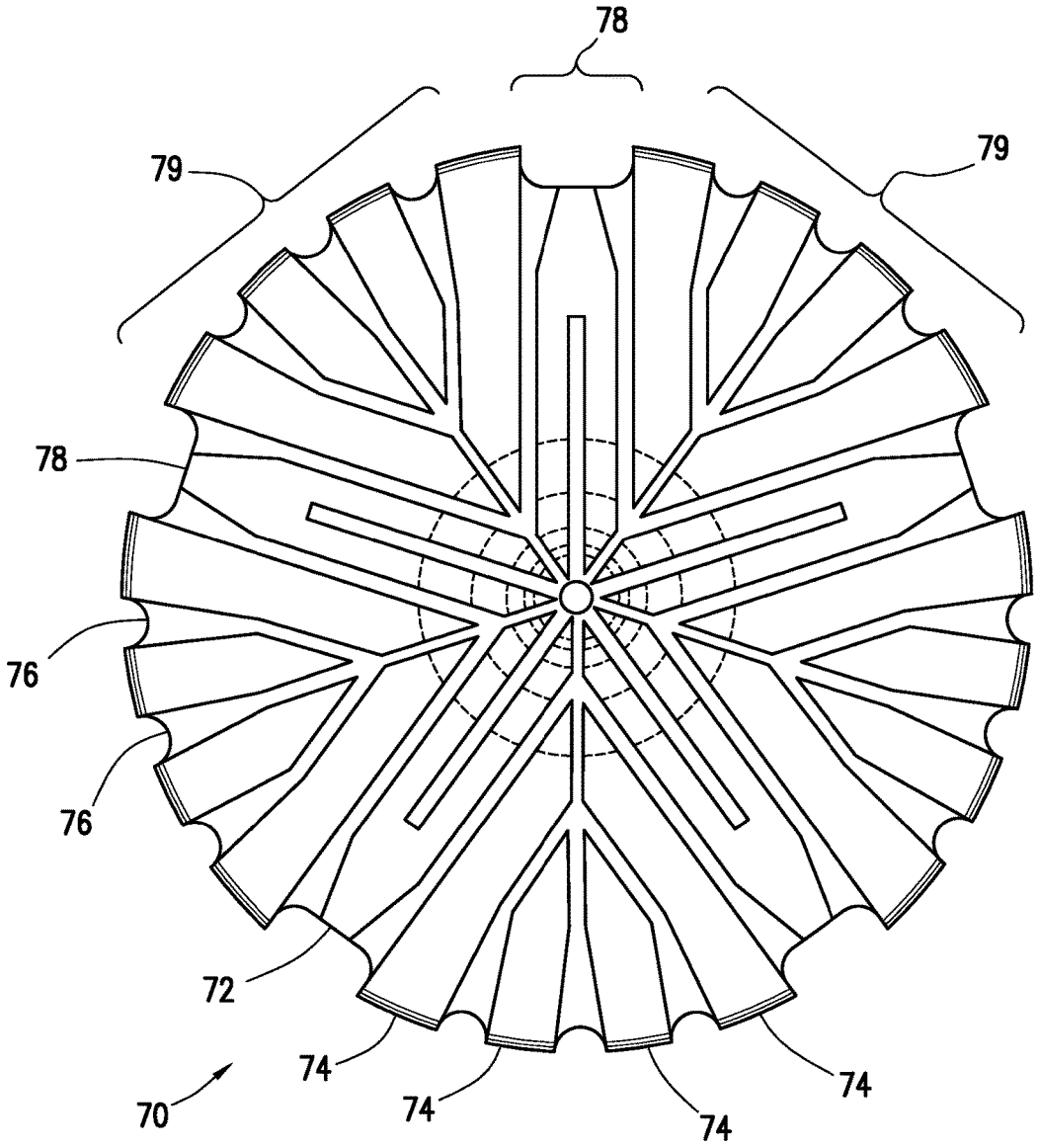
FIG. 4 (PRIOR ART)
FIG. 4 shows a top view of a conventional impregnated drill bit.
Figure 5:
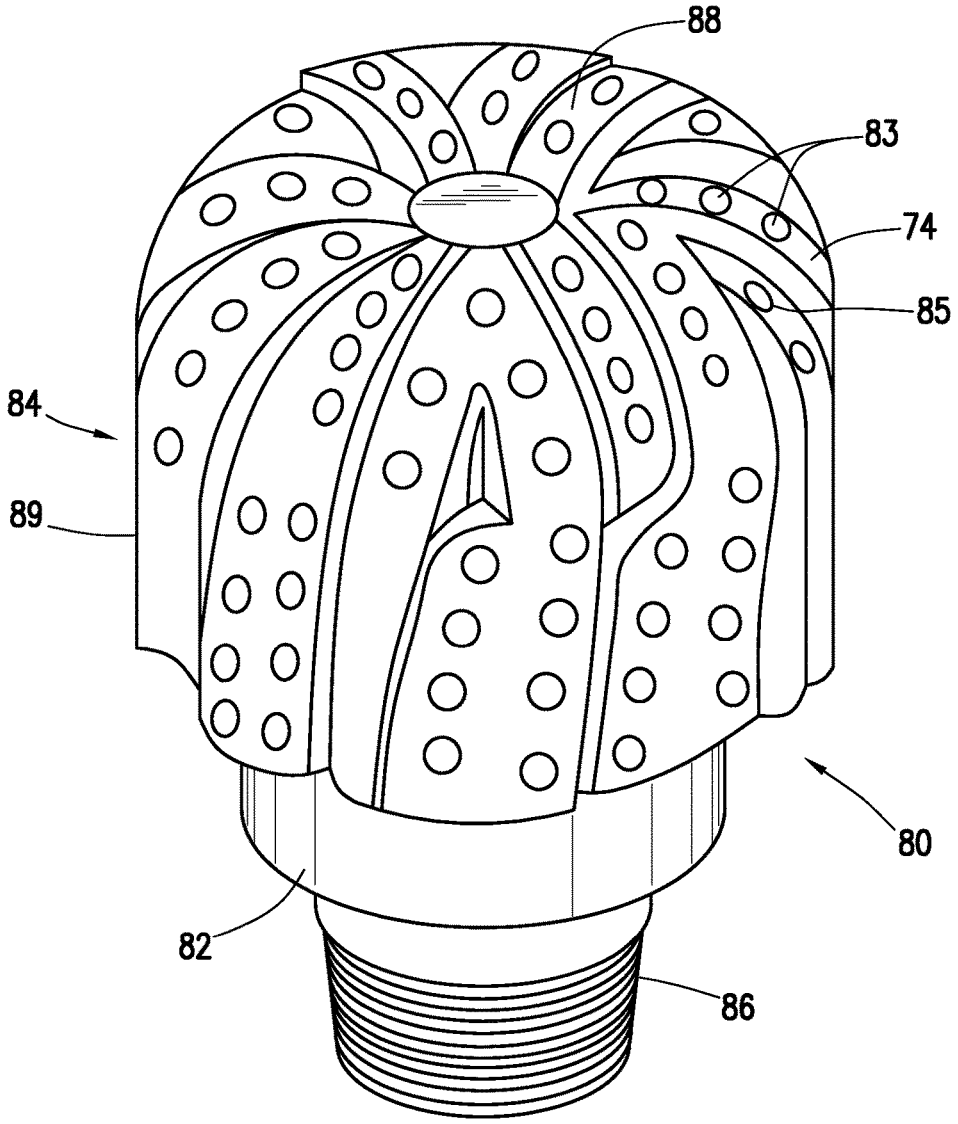
FIG. 5 (PRIOR ART)
FIG. 5 shows a perspective view of a conventional impregnated drill bit.
Figure 6:
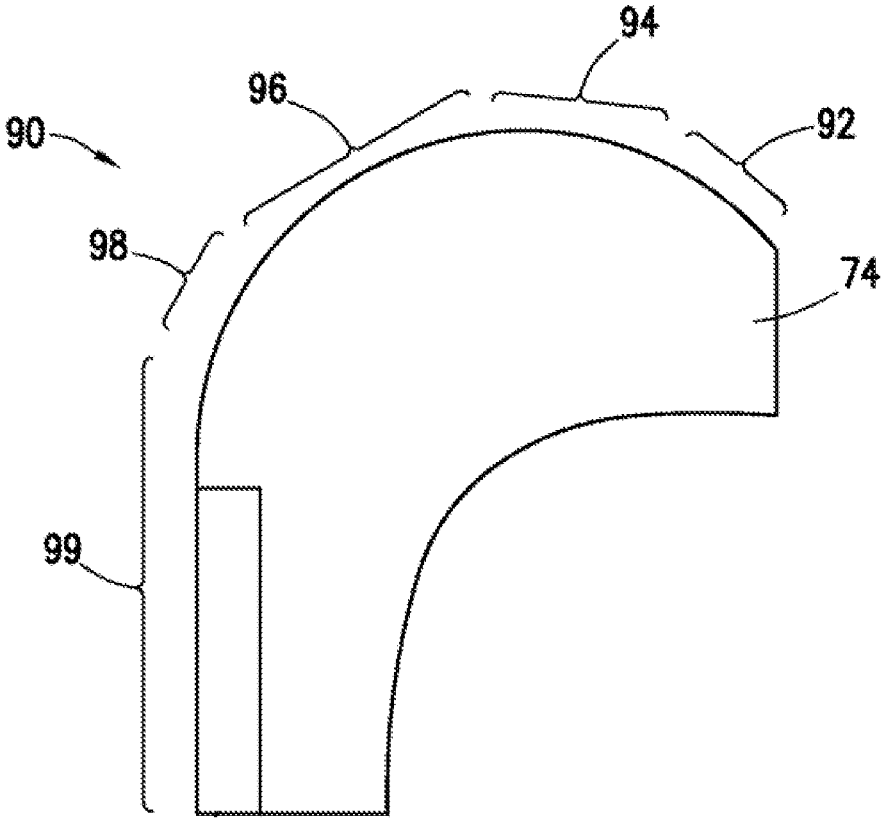
FIG. 6 (PRIOR ART)
FIG. 6 shows a cross-sectional view of a rib of a conventional impregnated drill bit.

In one or more of the above described embodiments, such location on the bit may be described through the cutting edge of one of the coring cutting elements (the two most radially interior cutting elements), in that the lowest axial point (remote from the pin) of the cutting edge of those coring cutting elements is within the length of two times a cutting face diameter of a cutting element in the nose region of the bit (as that term is defined in FIG. 3 above) from such cutting element in the nose region of the bit. In more particular embodiments, the lowest axial point (remote from the pin) of the cutting edge of those coring cutting elements is within the length of a single cutting face diameter of a cutting element in the nose region of the bit from such cutting element in the nose region of the bit. Whether it is within 2× or 1× (or less) of the nose cutting element may depend, for example, on the shape of the blade. Another way to consider the location of the coring cutting elements is relative to the gage region of the bit. In one or more other embodiments, the lowest axial point (remote from the pin) of the cutting edge of those coring cutting elements is axially below the cutting elements in the gage region (as that term is defined in FIG. 3 above). In this manner, the shape of the blade and coring cutting elements are differentiated from the conventional coring bit.

Figure 23:
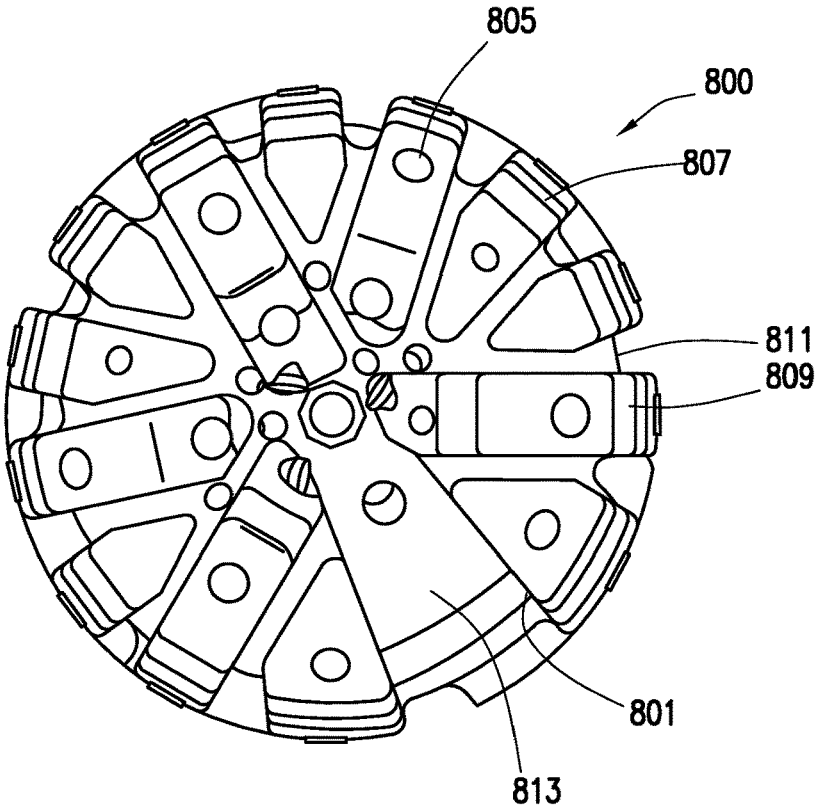
FIG. 23 shows an embodiment of an impregnated drill bit using the coring cutting elements of the present disclosure.

Referring now to FIG. 23, an embodiment of a fixed cutter drill bit is shown. As shown in FIG. 23, the fixed cutter drill bit 800 is a diamond impregnated bit. As shown in FIG. 23, bit body 801 supports a plurality of raised ribs 807. Similar to plurality of blades 715 of PDC bit 700 (illustrated in FIG. 7), according to one or more embodiments of the present disclosure, plurality of raised ribs 807 include a raised volume of material that extends at a height from a face of bit body 801. However, as appreciated by one of ordinary skill in the art, such "blades" on an impregnated drill bit are generally referred to in the art as "ribs." Plurality of raised ribs 807 are formed on an end of impregnated bit 800 that is opposite pin (not shown). As shown, plurality of raised ribs 807 extend radially outward from bit centerline 803, and then axially downward to define a diameter of impregnated bit 800.

According to one or more embodiments of the present disclosure, one of the plurality of raised ribs 807 is a coring rib 809, having a coring cutting element thereon, similar to the embodiments described above. Each of the variations of the coring cutting elements described in FIGS. 9-22 may be incorporated onto a diamond impregnated bit. In such an instance, one of ordinary skill in the art would appreciate that the coring cutting elements 725 (illustrated in FIGS.

9-22) may be the sole "cutters" as that term is generally understood in the art of PDC bits. Other "cutting structures" may include diamond impregnated inserts or diamond impregnated ribs, discussed below.

Plurality of raised ribs 807 are separated by a plurality of channels 811, which enable drilling fluid to flow between and both clean and cool plurality of raised ribs 807 during drilling. Optionally, one of the plurality of channels 811 is an evacuation slot 813, which is described in further detail below. As further shown in FIG. 17, each of plurality of raised ribs 807 includes an impregnated cutting structure, through either diamond (or other superabrasive) particles impregnated in the ribs 807 or a plurality of holes into which plurality of impregnated inserts 805 are disposed. It is also within the scope of the present disclosure that plurality of raised ribs 807 may include both diamond impregnation in the rib 807 itself as well as impregnation in inserts 805 fitted into holes formed in the raised ribs 807. According to one or more embodiments of the present disclosure, plurality of holes are sized and shaped to receive corresponding plurality of impregnated inserts 805. As shown, plurality of impregnated inserts 805 may be arranged adjacent one another and/or spaced along plurality of raised ribs 807. According to one or more embodiments of the present disclosure, plurality of impregnated inserts 805 may be oriented to be substantially parallel to bit centerline (not shown), or may be oriented to be substantially perpendicular to bit centerline (not shown), depending on the position of plurality of impregnated inserts 805 along plurality of raised ribs 807, or may be oriented in the same axial direction or plane as the rib 807. Plurality of impregnated inserts 805 and/or ribs 807 may be formed of natural or synthetic diamonds, as well as other non-superabrasive materials in order to achieve an abrasive cutting action while drilling a formation.

In various embodiments, cutting elements have been described as having "substantially the same" distance from a bit centerline or axial height. In each of those embodiments, such variation may be within 0.100 inches (2.54 mm). It is also noted that in each of such embodiments, it is also within the scope of the present disclosure that each of distances or heights may also be the same (within manufacturing tolerances).

Referring back to FIG. 7, in accordance with one or more embodiments of the present disclosure, the first coring cutting element is located at some distance away from bit centerline 709 to allow for the formation of core sample fragment 740. As a non-limiting example, according to one or more embodiments of the present disclosure, the radially most interior portion of the cutting edge of coring cutting element 725 is distanced from bit centerline 709 at a distance that measures 0.25 times the diameter of PDC bit 700. According to one or more embodiments of the present disclosure, the radially most interior portion of the cutting edge of coring cutting element 725 may be distanced from bit centerline 709 at a distance measuring in a range of 0.05 times the diameter of PDC bit 700 to 0.25 times the diameter of PDC bit 700. According to other embodiments of the present disclosure, the radially most interior portion of the cutting edge of coring cutting element 725 may be distanced from bit centerline 709 at a distance measuring in a range having a lower limit of any of 0.05, 0.075, 0.1, 0.125, or 0.15 times the diameter of PDC bit 700 to an upper limit of any of 0.075, 0.1, 0.125, 0.15, 0.175, 0.2, 0.225, or 0.25 times the diameter of PDC bit 700, where any lower limit may be used in combination with any upper limit. As understood by one of ordinary skill in the art, the radially most interior portion of the cutting edge of coring cutting element 725 may be located at other distances away from bit centerline 709, depending on the desired size of the core sample fragment 740, without departing from the scope of the present disclosure.

Further, it is also within the scope of the present disclosure that other features may be included on the fixed cutter drill bits of the present disclosure, including such features as discussed in U.S. Patent Publication No. 2013/0020134, which is assigned to the present assignee and herein incorporated by reference in its entirety, which may aid in the formation and/or evacuation of a core segment. Such features may include an evacuation channel, a center insert disposed proximate the bit centerline, and/or a relieved surface on the coring blade.

Figure 24:
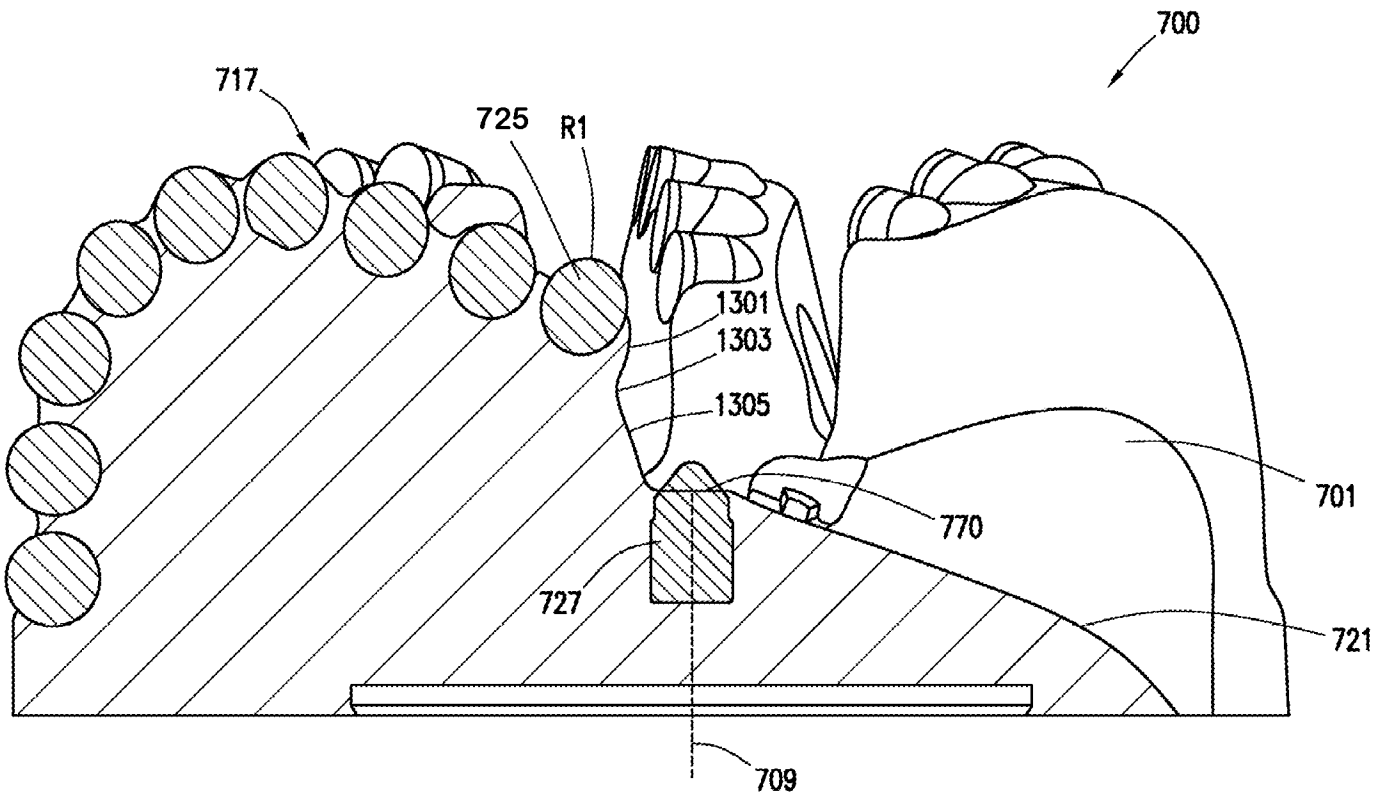
FIGS. 24-25 show an embodiment of a fixed cutter drill bit.
Figure 25:
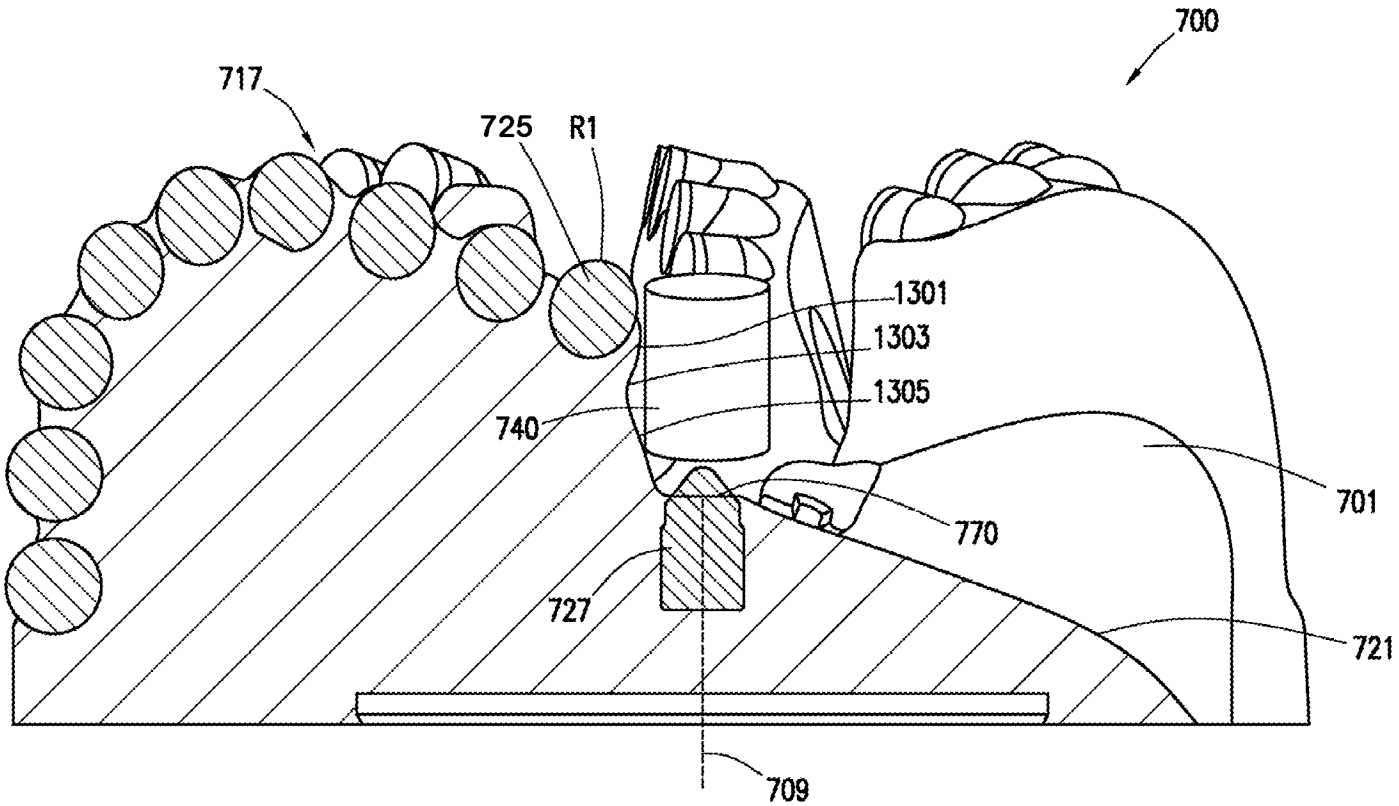

Referring back to FIG. 7, as well as to FIGS. 24 and 25, coring blade 717 may include substantially vertical surface 1301, relief 1303, and angled surface 1305. Angled surface 1305 is disposed axially above the blade top and axially below bit face 703, which extends through bit centerline 709. In some embodiments, bit face 703 may have an insert inserted into a hole therein, which may be on or proximate bit centerline 709. As shown, relief 1303 may be disposed between substantially vertical surface 1301 and angled surface 1305. Relief 1303 functions to relieve and protect substantially vertical surface 1301 from premature wear. According to one or more embodiments of the present disclosure, substantially vertical surface 1301, relief 1303, and angled surface 1305 are integrally connected to form a continuous piece, and are oriented to face bit centerline 709 of PDC bit 700.

According to other embodiments of the present disclosure, coring blade 717 may be configured without relief 1303. According to these other embodiments, substantially vertical surface 1301 and angled surface 1305 are integrally connected to form a continuous piece, and are oriented to face bit centerline 709 of PDC bit 700. Further, according to these other embodiments, substantially vertical surface 1301 and angled surface 1305 intersect at a point that is axially above first cutter 725 of coring blade 717.

According to one or more embodiments of the present disclosure, substantially vertical surface 1301 may be substantially parallel to bit centerline 709 of PDC bit 700. That is, according to one or more embodiments of the present disclosure, substantially vertical surface 1301 may be oriented such that substantially vertical surface 1301 is at an angle ranging from 0 to 5 degrees, in either direction, with respect to a line parallel to bit centerline 709 of PDC bit 700. As better shown in FIG. 25, the slope of angled surface 1305 helps determine the length of resulting core sample fragment 740. For example, the shallower the slope (i.e., the larger the degree of angle from bit centerline 709) of angled surface 1305, the longer the length of resulting core sample fragment 740. Likewise, the steeper the slope (i.e., the smaller the degree of angle from bit centerline 709) of angled surface 1305, the shorter the length of resulting core sample fragment 740. As understood by one of ordinary skill in the art, in addition to the slope of angled surface 1305, the height of coring blade 717 also helps determine the length of the resulting core sample fragment 740. For example, the taller the coring blade 717, the longer the length of resulting core sample fragment 740. Likewise, the shorter the coring blade 717, the shorter the length of resulting core sample fragment 740. Accordingly, as understood by one of ordinary skill in the art, angled surface 1305 may have an angle of various degrees from bit centerline 709, and coring blade 717 may have various heights in order to create core sample fragments 725 having various lengths without departing from the scope of the present disclosure. In a particular embodiment, angled surface 1305 may be disposed such that the axial point at which angled surface 1305 has a radial value equal to the radial position of the first coring cutting element 725 may have a lower limit of any of at least 0.1, 0.2, 0.3, 0.4, or 0.5 times the diameter of the bit, and an upper limit of any of 0.2, 0.3, 0.4, 0.5, 0.6, or 0.75 times the diameter of the bit, where any lower limit can be used in combination with any upper limit.

According to one or more embodiments of the present disclosure, angled surface 1305 has an angle in a range of 15 degrees to 20 degrees from bit centerline 709. However, in view of the above, this angle range is not intended to be limiting, and angled surface 1305 may have an angle of various degrees from bit centerline 709. For example, in one or more embodiments, angled surface 1305 may have a lower limit of any of about 5, 10, 15, 20, or 25 degrees, and an upper limit of any of 15, 20, 25, 30, 35, or 45 degrees. According to one or more embodiments of the present disclosure, angled surface 1305 may have any angle from bit centerline 709 that allows angled surface 1305 to exert a lateral load on a side of core sample fragment 740 that is sufficient to cause core sample fragment 740 to break away from formation after core sample fragment 740 reaches a desired length.

According to one or more embodiments of the present disclosure, relief 1303 may be disposed between substantially vertical surface 1301 and angled surface 1305. Relief 1303 functions to relieve and protect substantially vertical surface 1301 from premature wear. According to one or more embodiments of the present disclosure, the location of relief 1303 between substantially vertical surface 1301 and angled surface 1305 is based upon the desired length to width ratio of the resulting core sample fragment 740. According to one or more embodiments of the present disclosure, the ratio of the length of core sample fragment 740 to the width of core sample fragment 740 may be greater than or equal to one. As such, the location of relief 1303 is determined based on the height of the coring blade 717, the slope of angled surface 1305, and the location of radially interior portion of coring cutting element with respect to bit centerline 709, as previously described above. It is also within the scope of the present disclosure that any of the surfaces on coring blade 717 may be modified to include a low friction abrasion resistant material, such as thermally stable polycrystalline diamond (TSP), natural diamond, or any other type of thermally stable abrasion resistant material, which may include embedded pieces of such material on such surfaces.

Further, a center insert 727 (conical insert as illustrated, but other shaped cutting elements may be used) is disposed on or proximate bit centerline 709. As used herein, "proximate" with respect to bit centerline 709 means either on bit centerline 709 or between bit centerline 709 and coring cutting element 725. According to one or more embodiments of the present disclosure, conical insert 727 is embedded in bit body 701 such that an apex of conical insert 727 is positioned axially above relief 1303 of coring blade 717. In one or more embodiments, the center insert may have other geometric shapes (other than conical) and be substantially pointed (with a rounded apex). As shown, conical insert 727 is disposed on or proximate bit centerline 709 at a support surface 770 of bit body 701. According to one or more embodiments of the present disclosure, support surface 770 is disposed between coring blade 717 and evacuation slot 721 of PDC bit 700. According to one or more embodiments of the present disclosure, support surface 770 integrally connects coring blade 717 to evacuation slot 721 in a continuous piece. Further, according to one or more embodiments of the present disclosure, support surface 770 has a slope of less than 5 degrees, less than 3 or 2 degrees in other embodiments, or may even have a slope of zero with respect to bit centerline 709.

For example, an evacuation slot 721 may be included to aid in the evacuation of core samples from the bit. Evacuation slot 721 is shown positioned directly across bit centerline 709 relative to coring blade 717. According to one or more embodiments of the present disclosure, a profile of evacuation slot 721 is recessed below bit body 701 of PDC bit 700. As understood by one of ordinary skill in the art, the amount that evacuation slot 721 is recessed below bit body 701 may vary without departing from the scope of the present disclosure. For example, as appreciated by one of ordinary skill in the art, evacuation slot 721 may be recessed below bit body 701 by an amount that is sufficient to ensure a smooth exit of core sample fragment 740 from evacuation slot 721 in order to avoid bit plugging. Further, as appreciated by one of ordinary skill in the art, evacuation slot 721 may be recessed below bit body 701 by an amount that does not compromise the blank strength of PDC bit 700. Therefore, according to one or more embodiments of the present disclosure, evacuation slot 721 is recessed below bit body 701 of PDC bit 700 by an amount that allows smooth exit of core sample fragment 740 without bit plugging, and by an amount that does not adversely affect the service life of PDC bit 700. According to one or more embodiments of the present disclosure, evacuation slot 721 has a generally downward slope with respect to support surface 770 and bit body 701.

As mentioned above, it is also within the scope of the present disclosure that any of the coring cutting elements may be selected from shear cutters (a diamond table disposed on a carbide substrate, which is brazed into a cutter pocket), rolling cutters (in having a cutting element that is free to rotate about its own axis), or non-planar cutting elements having a substantially pointed cutting surface (such as conical cutting elements, bullet shaped cutting elements or other cutting surface shapes).

Although only a few example embodiments have been described in detail above, those skilled in the art will readily appreciate that many modifications are possible in the example embodiments without materially departing from this invention. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A fixed cutter drill bit, comprising:

a bit body having a bit centerline;

a plurality of blades extending radially from the bit body and separated by a plurality of flow courses therebetween, each of the plurality of blades being spaced a radial distance from the bit centerline to define a core-forming region; and a plurality of cutting elements, each of the plurality of cutting elements comprising a substrate, disposed on the plurality of blades, the plurality of cutting elements comprising at least two coring cutting elements disposed on the plurality of blades, the at least two coring cutting elements being the radially innermost cutting elements on the plurality of blades, and the substrates of one of the at least two coring cutting elements having a different diameter than the substrates of the other of the at least two coring cutting elements, wherein cutting zones of the at least two coring cutting elements having substrates of different diameters at least partially overlap in a cutting profile view that includes each of the plurality of cutting elements, wherein the at least two coring cutting elements are oriented such that a cutting edge of each of the at least two coring cutting elements is configured to cut a cylindrical core, and wherein one of the at least two coring cutting elements has a non-planar cutting surface and another of the at least two coring cutting elements has a planar cutting face, the non-planar cutting surface including an apex at a same radial position as a cutting tip on the cutting edge of the coring cutting element having the planar cutting face.

2. The fixed cutter drill bit of claim 1, the at least two coring cutting elements sharing a tangent.

3. The fixed cutter drill bit of claim 2, wherein an entirety of the cutting zone of one of the at least two coring cutting elements overlaps with a partial cutting zone of another of the at least two coring cutting elements.

4. The fixed cutter drill bit of claim 1, wherein one of the two coring cutting elements has a reduced axial exposure as compared to the other.

5. The fixed cutter drill bit of claim 1, wherein a radial distance from the bit centerline to a cutting face of one of the at least two coring cutting elements is greater as compared to the other of the at least two coring cutting elements.

6. A fixed cutter drill bit, comprising:

a bit body having a bit centerline;

a plurality of blades extending radially from the bit body and separated by a plurality of flow courses therebetween, each of the plurality of blades being spaced a radial distance from the bit centerline to define a core-forming region; and a plurality of cutting elements, each of the plurality of cutting elements comprising a substrate, disposed on the plurality of blades, the plurality of cutting elements comprising at least two coring cutting elements disposed on the plurality of blades, the at least two coring cutting elements being the radially innermost cutting elements on the plurality of blades, the substrates of one of the at least two coring cutting elements having a different diameter than the substrates of the other of the at least two coring cutting elements and having cutting zones, wherein at least a portion of the cutting zone of the at least two coring cutting elements overlap in a cutting profile view that includes each of the plurality of cutting elements;

wherein the at least two coring cutting elements are aligned to have a cutting zone that extends to substantially the same radial distance from the bit centerline or axial height, wherein the at least two coring cutting elements are oriented such that a cutting edge of each of the at least two coring cutting elements is configured to cut a cylindrical core, and wherein one of the at least two coring cutting elements has a non-planar cutting surface and another of the at least two coring cutting elements has a planar cutting face, the non-planar cutting surface including an apex at a same radial position as a cutting tip on the cutting edge of the coring cutting element having the planar cutting face.

7. The fixed cutter drill bit of claim 6, wherein an entirety of the cutting zone of one of the at least two coring cutting elements overlaps with a partial cutting zone of another of the at least two coring cutting elements.

8. The fixed cutter drill bit of claim 6, wherein the at least two coring cutting elements of different diameters share a tangent that is parallel to the bit centerline at the same radial distance from the bit centerline that defines a radially innermost position of the cutting zones of the least two coring cutting elements.

9. The fixed cutter drill bit of claim 6, wherein one of the two coring cutting elements has a reduced axial exposure as compared to the other.

10. A fixed cutter drill bit, comprising:

a bit body having a bit centerline;

a plurality of blades extending radially from the bit body and separated by a plurality of flow courses therebetween, each of the plurality of blades being spaced a radial distance from the bit centerline to define a core-forming region; and a plurality of cutting elements, each of the plurality of cutting elements comprising a substrate, disposed on the plurality of blades, the plurality of cutting elements comprising at least two coring cutting elements disposed on the plurality of blades, the at least two coring cutting elements being the radially innermost cutting elements on the plurality of blades, the substrates of one of the at least two coring cutting elements having a different diameter than the substrates of the other of the at least two coring cutting elements and having cutting zones, wherein at least a portion of the cutting zone of the at least two coring cutting elements overlap in a cutting profile view that includes each of the plurality of cutting elements, and wherein the at least two coring cutting elements share a tangent;

wherein an axial centerline of each of the at least two coring cutting elements are at substantially the same radial distance from the bit centerline, wherein the at least two coring cutting elements are oriented such that a cutting edge of each of the at least two coring cutting elements is configured to cut a cylindrical core, and wherein one of the at least two coring cutting elements has a non-planar cutting surface and another of the at least two coring cutting elements has a planar cutting face, the non-planar cutting surface including an apex at a same radial position as a cutting tip on the cutting edge of the coring cutting element having the planar cutting face.

11. The fixed cutter drill bit of claim 10, wherein an entirety of the cutting zone of one of the at least two coring cutting elements overlaps with a partial cutting zone of another of the at least two coring cutting elements.

12. The fixed cutter drill bit of claim 10, wherein one of the two coring cutting elements has a reduced axial exposure as compared to the other.

13. The fixed cutter drill bit of claim 10, wherein a radial distance from the bit centerline to a cutting face of one of the at least two coring cutting elements is greater as compared to the other of the at least two coring cutting elements.

14. A fixed cutter drill bit, comprising:

a bit body having a bit centerline;

a plurality of blades extending radially from the bit body and separated by a plurality of flow courses therebetween, each of the plurality of blades being spaced a radial distance from the bit centerline to define a core-forming region; and a plurality of cutting elements disposed on the plurality of blades and which when rotated into a single plane define a cutting profile that includes each of the plurality of cutting elements, the plurality of cutting elements comprising:

a first coring cutting element, comprising a substrate, disposed on one of the plurality of blades, the first coring cutting element being the radially most interior of the plurality of cutting elements, wherein the first coring cutting element comprises a core-cutting quadrant that is defined as the region in the cutting profile between a first tangent of the first coring cutting element's cutting edge that is parallel to the bit centerline, a second tangent of the first coring cutting element's cutting edge that is perpendicular to the bit centerline, and an arc length of the first coring cutting element's cutting edge between the first and second tangent; and a second coring cutting element, comprising a substrate, disposed on one of the plurality of blades, the second coring cutting element having a cutting zone in the cutting profile that is at least partially within the core-cutting quadrant or overlapping the arc length defining the core-cutting quadrant, the substrate of the first coring cutting element having a different diameter than the substrate of the second coring cutting element, wherein the first coring cutting element and the second coring cutting element are oriented such that a cutting edge of each of the first and second coring cutting elements is configured to cut a cylindrical core, and wherein the second coring cutting element has a non-planar cutting surface and the first coring cutting element has a planar cutting surface, and wherein an apex of the second coring cutting element is at a same radial position as a cutting tip on the cutting edge of the first coring cutting element.

* * * * *